United States Patent [19]

Bruderer et al.

[11] Patent Number: 4,550,641

[45] Date of Patent: Nov. 5, 1985

[54] SAFETY APPARATUS IN EXTERNALLY POWERED FIRING WEAPON

[75] Inventors: Werner Bruderer; Hans Brieger; Ernst Hürlemann, all of Zurich, Switzerland

[73] Assignee: Werkzeugmaschinenfabrik Oerlikon-Bührle AG, Zurich, Switzerland

[21] Appl. No.: 555,689

[22] Filed: Nov. 28, 1983

[30] Foreign Application Priority Data

Dec. 8, 1982 [CH] Switzerland ..... 7127/82
Jan. 28, 1983 [CH] Switzerland ..... 489/83

[51] Int. Cl.[4] ..... F41F 11/00
[52] U.S. Cl. ..... 89/12; 89/11
[58] Field of Search ..... 89/12, 9, 11, 13.05, 89/185, 182, 183

[56] References Cited

U.S. PATENT DOCUMENTS 3,921,499 11/1975 Ginsky ..... 89/12
4,131,052 12/1978 Skahill ..... 89/11
4,154,143 5/1979 Pechamat et al. ..... 89/11
4,164,889 8/1979 Elmore et al. ..... 89/11 X
4,193,335 3/1980 Tassie ..... 89/11 X
4,301,710 11/1981 Kirkpatrick ..... 89/12

FOREIGN PATENT DOCUMENTS 1809699 11/1968 Fed. Rep. of Germany .
534689 3/1922 France .

*Primary Examiner*—David H. Brown
*Attorney, Agent, or Firm*—Werner W. Kleeman

[57] ABSTRACT

In weapons in the nature of a Gatling gun the danger exists with an ignition delay or hangfire that the cartridge still is ignited after the positively reciprocated breechblock has been unlocked. However, cartridge ignition is undesired after unlocking of the breechblock. Therefore, an apparatus is present with the invention preventing unlocking of the breechblock in case of an ignition delay. Such safety apparatus may respond to (a) the gas pressure, (b) the weapon recoil, (c) the forward advance of the weapon or (d) to an expansion or bulge formed in a cartridge case, and acts to separate a breechblock head from a breechblock carrier, the breechblock head remaining in its locked position.

The apparatus comprises either an inertia mass displaced relative to the breechblock due to the recoil action or a cam plate mounted at the weapon cradle and responding to the forward advance of the weapon, or a feeler pin responsive to an expansion or bulge formed in the cartridge case. The apparatus may cause a deflection of a cam follower roll from a first control cam into a second control cam, whereby the breechblock remains in its locked position.

10 Claims, 26 Drawing Figures

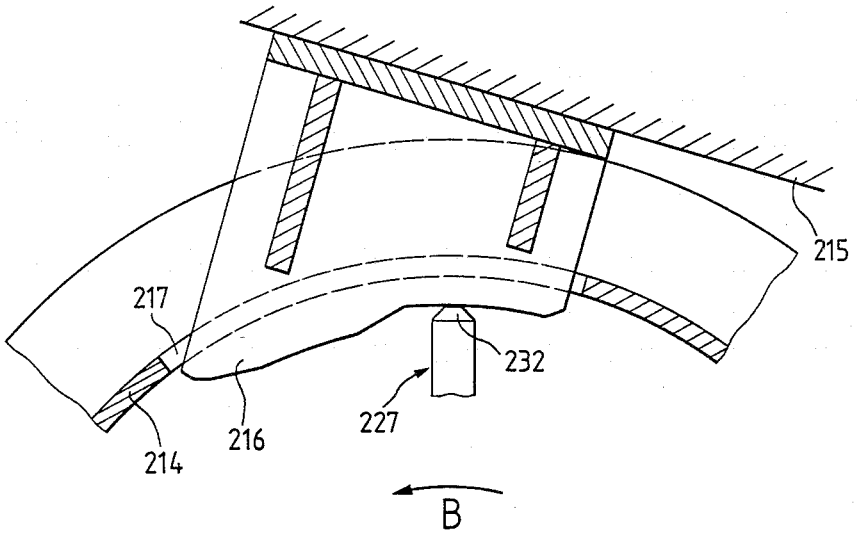
FIG. 17
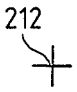
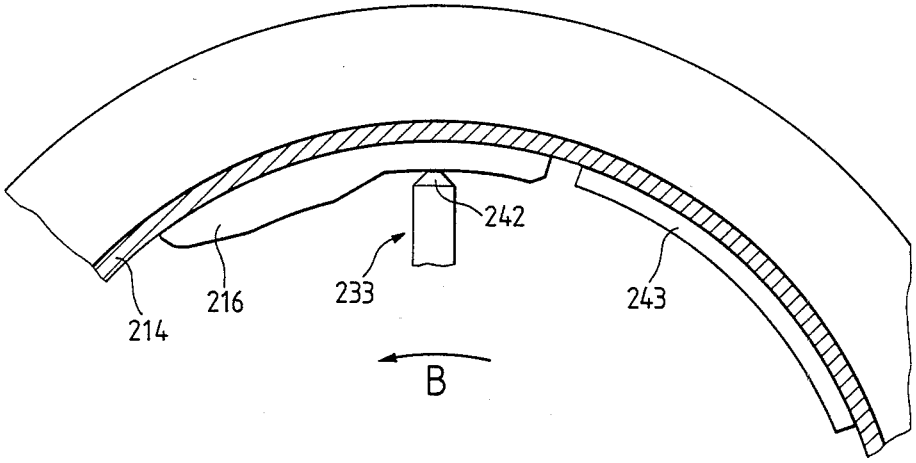
FIG. 21
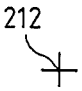

SAFETY APPARATUS IN EXTERNALLY POWERED FIRING WEAPON

BACKGROUND OF THE INVENTION

The present invention broadly relates to a new and improved safety apparatus or equipment for an externally powered weapon or firing system including a weapon barrel and a positively reciprocating or to-and-fro moving breechblock which can be locked in its forwardmost position.

In its more particular aspects the present invention relates to new and improved safety apparatus or equipment for a multi-barrel weapon mounted for recoil movement at a cradle and displaceable from a forward position into a rearward position under recoil action of the weapon. There is provided a weapon housing containing a rotor rotatable therein at which a cluster of barrels is arranged. Each- weapon barrel is provided with a respective breechblock which can be locked to the weapon barrel prior to firing a round.

An apparatus of this kind is known, for example, from German Patent Publication No. 1,809,699, published Aug. 7, 1969, and serves to interrupt series firing of an automatic rapid firing weapon in the nature of a Gatling gun in the event that a cartridge or a cartridge case is not withdrawn from the cartridge chamber of a related weapon barrel. In this known apparatus there are present means for preventing further supply of projectiles to the cartridge chamber of the weapon barrel in the event that a cartridge which has not yet been withdrawn is present in the cartridge chamber after rotation of the weapon barrel cluster. Such means comprises a sensing or feeler element which prevents the forward or advance motion of the breechblock when such sensing element contacts the cartridge which has not been withdrawn from the cartridge chamber. For this purpose there is present a deflector or switching structure which may assume a first position in which the forward or advance motion of the breechblock is prevented and a second position in which the forward or advance motion of the breechblock is enabled, the deflector or switching structure being coupled to the sensing element.

This prior art device has the disadvantage that premature unlocking of the breechblock cannot be prevented in the event of an ignition delay or hangfire of a cartridge. Thus, there exists the danger that in the presence of such a condition the propellant charge of the cartridge is undesirably ignited after unlocking of the breechblock. When a cartridge is still ignited or fired after unlocking of the breechblock, this may result in destruction of essential parts of the weapon. Furthermore, the operating or gunnery personnel for the weapon are endangered.

In a multi-barrel weapon in the nature of a Gatling gun a cluster or group of barrels is mounted to a rotor rotating in a weapon housing about the central axis of the weapon barrel cluster. Such rotor contains guide tracks or paths arranged in longitudinal direction of the weapon, each guide track guiding a related breechblock operatively associated with a predetermined barrel of the weapon barrel cluster. The cartridges are first rammed into the weapon barrels by the forward and rearward travel of the breechblocks along the guide tracks. After weapon firing, the empty cartridge cases are withdrawn from the weapon barrels by the same breechblocks and ejected while the rotor rotates about its lengthwise axis. To displace the breechblocks between their foremost, locked position and their rear position in which the empty cartridge cases are ejected, there is present a cam follower roll at each breechblock. An elliptic control cam is present at the weapon housing within which the rotor is mounted and the cam follower roll engages with the control cam. Furthermore, there is present a cartridge infeed device for feeding or loading cartridges from a supply magazine into the aforementioned weapon housing where the cartridges are engaged by the breechblocks. Each breechblock is positively reciprocated due to the elliptically curved track or control cam.

SUMMARY OF THE INVENTION

Therefore, with the foregoing in mind it is a primary object of the present invention to provide a new and improved safety apparatus or equipment for an externally powered weapon containing at least one weapon barrel into which cartridges are insertable which may be subject to ignition or firing delay, which safety apparatus reliably prevents the propellant charge of a cartridge from still being ignited after unlocking of the breechblock.

Another important object of the present invention is directed to an improved safety apparatus which maintains the breechblock locked to its related weapon barrel in the event of a misfire condition.

Now in order to implement the aforementioned objects and still further objects of the invention, which will become more readily apparent as the description proceeds, the safety apparatus of the present development is manifested by the features that, the breechblock comprises a breechblock carrier and a breechblock head which are coupled to each other, and an arrangement or means are provided for decoupling the breechblock carrier from the breechblock head when the latter is locked to the weapon barrel, and which arrangement or means respond to an ignition delay of the cartridge.

Such arrangement or means may respond, for example, to the absence or non-occurrence of the propellant-charge gas pressure. In this case a gas intake or removal passage or channel is present in the weapon barrel in order to displace a gas pressure operable piston from an operative or working position into an inoperative or rest position under the action of gas pressure. The aforementioned arrangement is connected to the gas pressure operable piston and prevents unlocking of the breechblock in the event that the gas pressure operable piston remains in its operative position when encountering an ignition delay or hangfire condition.

The arrangement or means may also respond, for example, to the absence of weapon barrel recoil under the action of the force generated by the propellant charge gases, in which case the arrangement or means respond either to the weapon recoil or to the subsequent forward or counter-recoil movement of the weapon relative to the stationary cradle of the weapon system.

In the first case a cam plate is mounted to the weapon housing and an inertia mass is displaceably arranged at the breechblock. The inertia mass can, be displaced from an operative position into an inoperative position relative to the weapon under the action of the weapon recoil, in order to thus prevent unlocking of the breechblock in the event that the inertia mass remains in its operative position upon encountering an ignition delay or hangfire condition.

In the second case a cam plate is mounted at the cradle and is brought into engagement with an actuating mechanism when the weapon is in its forward or advance position. Unlocking of the breechblock is thus prevented in case that the weapon is forwardly moved from its rear position in an ignition delay condition.

Finally, the arrangement may also respond to the absence of a gas pressure generated in the cartridge case. In such a case there is present a recess in a chamber of the weapon barrel which chamber accommodates the cartridge. Due to the gas pressure the cartridge case is expanded into the recess. A feeler or contact element protrudes into the recess and is displaceable from an operative position into an inoperative position. An actuating mechanism is connected to the feeler or contact element to prevent unlocking of the breechblock in the event that the feeler or contact element remains in its operative position when encountering an ignition delay or hangfire condition.

Furthermore, to achieve the aforementioned objects there is further present in the weapon barrel a gas intake passage or channel cooperating with a gas pressure operable piston which is displaced from an operative position into an inoperative position under the action of gas pressure. An actuator mechanism is connected to the gas pressure operated piston in order to prevent unlocking of the breechblock in the event that the gas pressure operated piston remains in its operative or working position.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 17 is a cross-section along the line XVII—XVII in FIG. 16;

FIG. 21 is a section along the line XXI—XXI in FIG. 18;

DETAILED DESCRIPTION OF THE PREFERRED EMBODIMENTS

Figure 1:
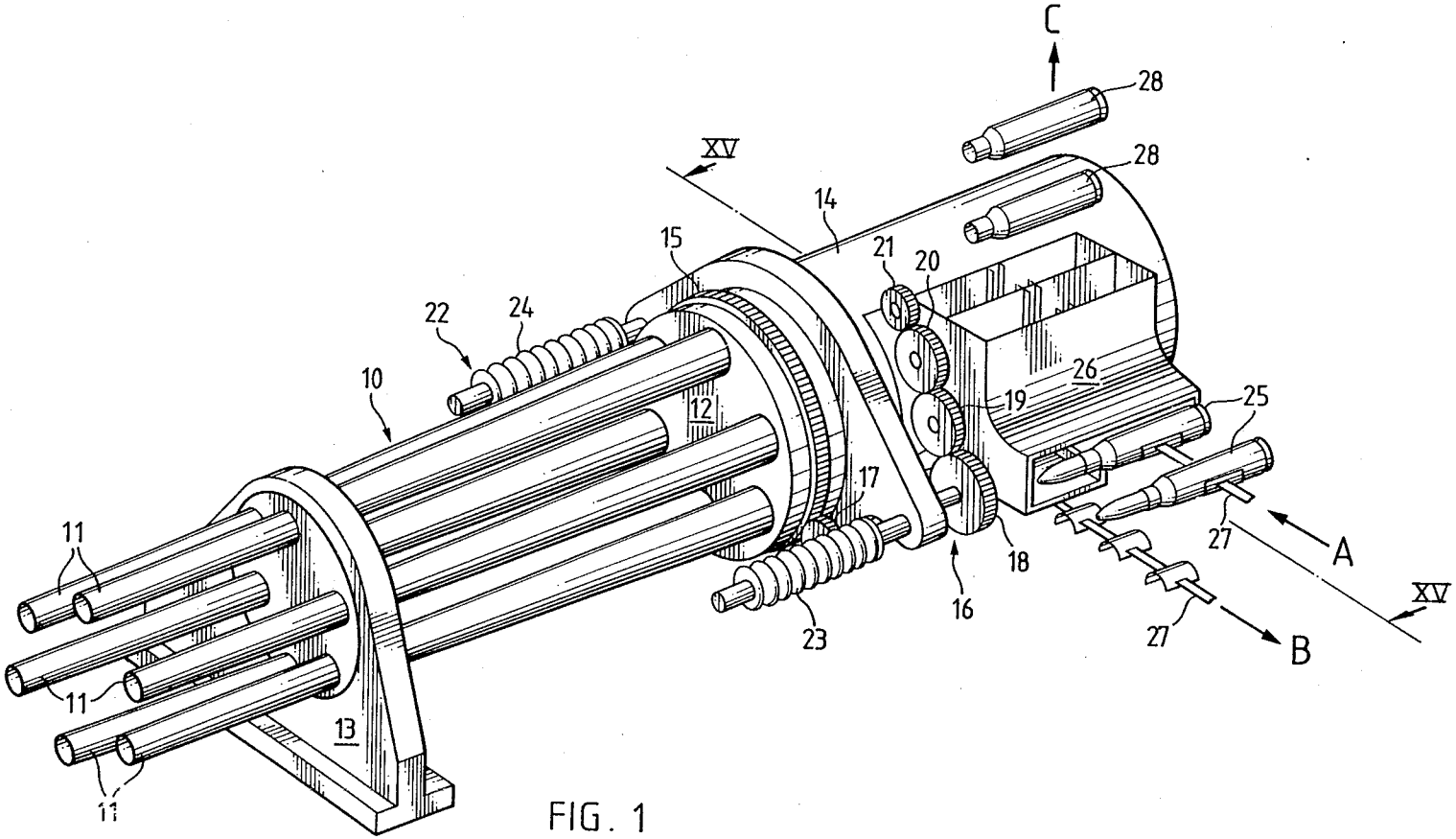
FIG. 1 is a perspective view of a multi-barrel weapon or weapon system in the nature of a Gatling gun equipped with a first exemplary embodiment of the safety apparatus or equipment constructed according to the present invention.

Describing now the drawings, it is to be understood that only enough of the construction of the firing weapon or weapon system including the safety apparatus or equipment according to the invention has been shown as needed for those skilled in the art to readily understand the underlying principles and concepts of the present development, while simplifying the showing of the drawings. Turning attention now specifically to the exemplary embodiment of FIG. 1, there has been illustrated in perspective view therein a Gatling gun comprising a cluster or group 10 of, for instance, six weapon barrels 11 which are mounted at a rotor 12 at their rear ends. The weapon barrel cluster 10 is appropriately rotatably mounted, at its front end in a support 13. The rotor 12 is also rotatably mounted at a weapon housing 14. A gear rim or gear structure 15 is mounted to the rotor 12 and operatively engages with a transmission or gearing system 16. Five gears 17 to 21 of the transmission or gearing system 16 are visible in the drawing of FIG. 1. The rotor 12 including the weapon barrel cluster 10 are driven via the transmission or gearing system 16 in conventional manner by means of any suitable electromotor which is not here particularly shown. Tne weapon housing 14 is mounted at an appropriate recoil arrangement here essentially composed of two plate spring packages or packets 23 and 24. An ammunition feed housing or body 26 is mounted at the weapon housing 14 for infeeding or loading cartridges 25. The cartridges 25 are fed to the ammunition feed housing or body 26 by an endless belt conveyor 27 in the direction of the arrow A. The empty belt conveyor 27 is moved in the direction of the arrow B to a not particularly illustrated ammunition container. The empty cartridge cases 28 are ejected from the ammunition feed housing or body 26 in the direction of the arrow C.

Figure 2:
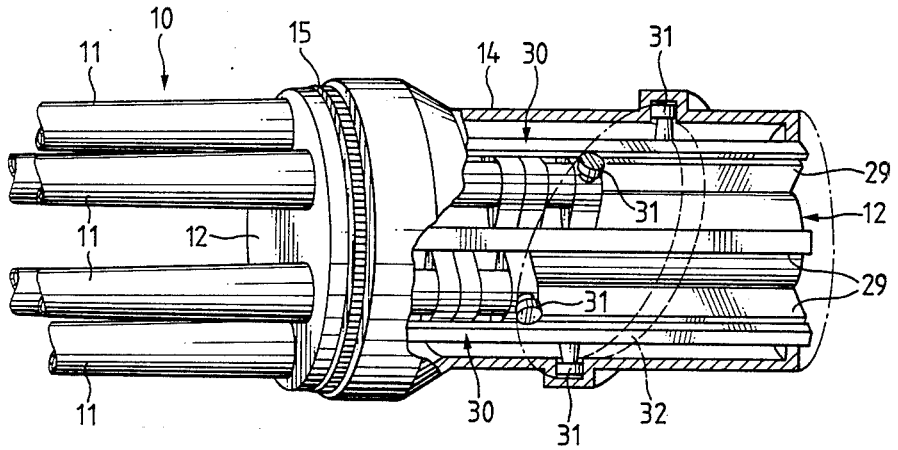
FIG. 2 is a perspective view of a rotor including a sectional view of a weapon housing of the weapon shown in FIG. 1.

As shown in FIG. 2 of the drawings, the rotor 12 which is rotatably mounted in the weapon housing 14 comprises guide rails 29 defining guide tracks. A respective breechblock 30 is displaceably supported between each two such guide rails 29. At each breechblock 30 there is mounted a cam follower roll 31 or the like which engages with a control cam 32 for the breechblock 10. The control cam 32 for the breechblocks 10 is located within the weapon housing 14 and causes each breechblock 30 to be reciprocated or moved back-and-forth once during each complete revolution of the rotor 12 within the weapon housing 14. In a manner known in this art a cartridge 25 is pushed into the weapon barrel 11 when the related breechblock 30 is forwardly displaced. The empty cartridge case 28 is withdrawn from the weapon barrel 11 and ejected during the return movement or retraction of the breechblock 30. Each breechblock 30 is locked in its foremost or forwardmost position thereof prior to firing the round. The breechblock 30 is again unlocked as soon as the round is fired. Since, as stated hereinbefore, the rotor 12 is driven by an electromotor, the advance or forward motion of the breechblock 30, the locking and unlocking thereof and the return motion thereof are positively effected.

An ignition delay or a hangfire condition can occur in the event that a cartridge 25 is not ignited or fired within the proper time. In such case it could happen that the breechblock 30 is again already unlocked prior to actual firing of such round.

The safety apparatus or equipment according to the invention, which actually is an anti-hangfire device and responds to the gas pressure generated in the weapon barrel upon firing, prevents, in the case of delayed ignition, that the breechblock 30 will be prematurely unlocked. The anti-hangfire device will be described hereinbelow.

Figure 3:
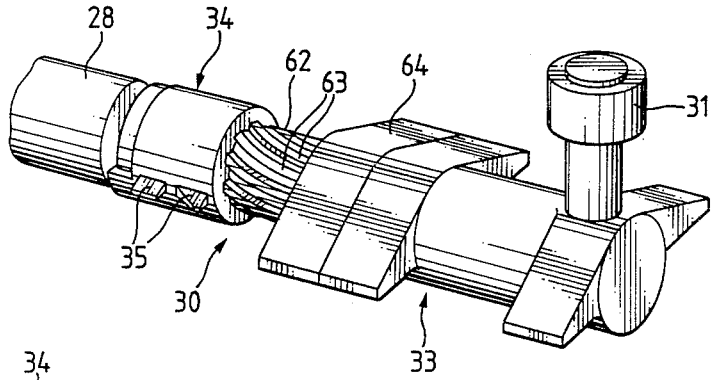
FIG. 3 is a perspective view of one of the breechblocks of the weapon shown in FIG. 1 and illustrated in a coupled position.
Figure 4:
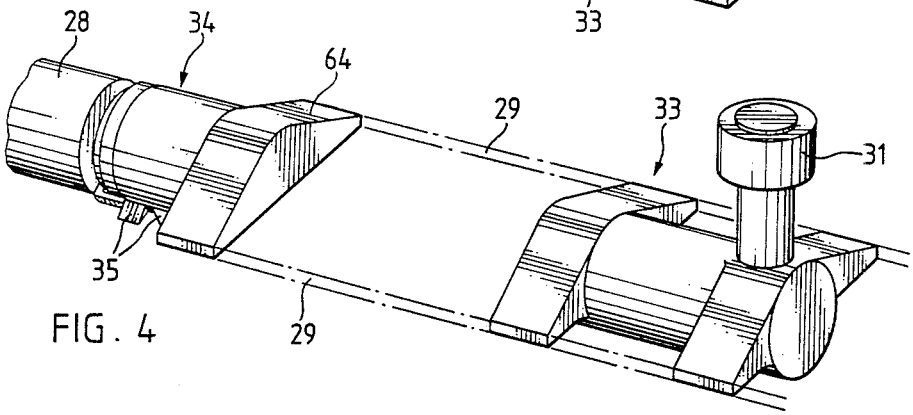
FIG. 4 is a perspective view of the breechblock shown in FIG. 3 in the decoupled or uncoupled position thereof.

As shown in FIG. 3, the breechblock 30 comprises a breechblock carrier 33 and a breechblock head 34 which are operatively coupled to each other but, as will be evident from FIG. 4, can be decoupled or separated rrom each other. Such a separation or decoupling of the breechblock head 34 and the breechblock carrier 33, however, occurs only in the aforementioned hangfire or ignition delay condition.

The breechblock head 34 comprises, for instance, ten locking cams or dogs 35 only a part of which, however, is visible in FIG. 3. The locking cams 35 are locked within the rotor 12 by rotation of the breechblock head 34. A locking member 62 is displaceably mounted at the breechblock head 34 and comprises helical ribs extending ar a steep pitch or inclination. The locking member 62 is displaced from the position shown in FIG. 3 into the position shown in FIG. 4 as soon as the breechblock head 34 has arrived at its forwardmost position when the breechblock 30 is advanced. Since the locking member 62 is mounted in a breechblock head support or holder 64 in such a way as ro be prevented from rotation with respect thereto, the breechblock head 34 is rotated due to the helical shape of the ribs 63 during the advance or forward motion of the breechblock 30. The breechblock head 34 is thus locked in the rotor 12 in a bayonet-like manner. Such locking of tne breechblock head 34 will also be evident from FIG. 6.

Figure 5:
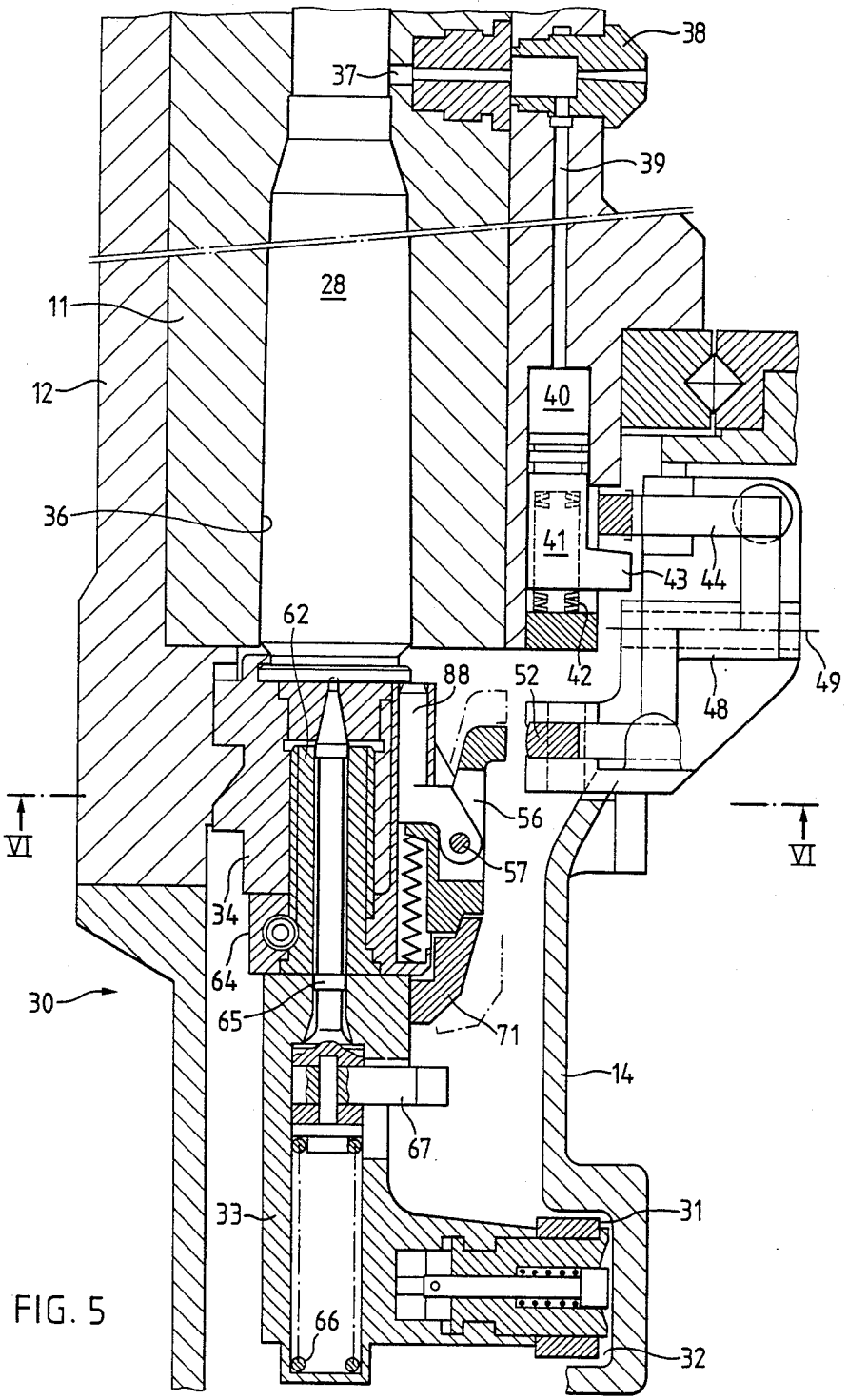
FIG. 5 is a radial section through part of the rotor shown in FIG. 2, with one of the breechblocks shown in the locked position thereof.

In accordance with FIG. 5 of the drawings, the weapon barrel 11 which is mounted at the rotor 12 comprises a loading or charging chamber 36 for receiving a cartridge. At the front end of the chamber 36, i.e. adjacent the mouth of a cartridge case 28, there is present a gas intake orifice or opening 37. The gas intake orifice 37 flow communicates with a gas intake passage or channel 39 through a deflecting nozzle 38. The gas intake passage or channel 39 opens into a gas chamber 40 in which a gas pressure operable piston 41 is displaceably mounted. A spring 42 is located in the interior of the gas pressure operable piston 41 and bears against the bottom or floor of the gas chamber 40. This spring 42 tends to displace the gas pressure operable piston 41 towards the front, i.e. to the top as viewed in FIG. 5 The gas pressure operable piston 41 further comprises a cam or dog 43 which serves to operate a lever 44 which is a member of an actuator or actuating mechanism for decoupling tne breechblock head 34 from the breechblock carrier 33 when confronted with an ignition delay or hangfire condition.

Figure 6:
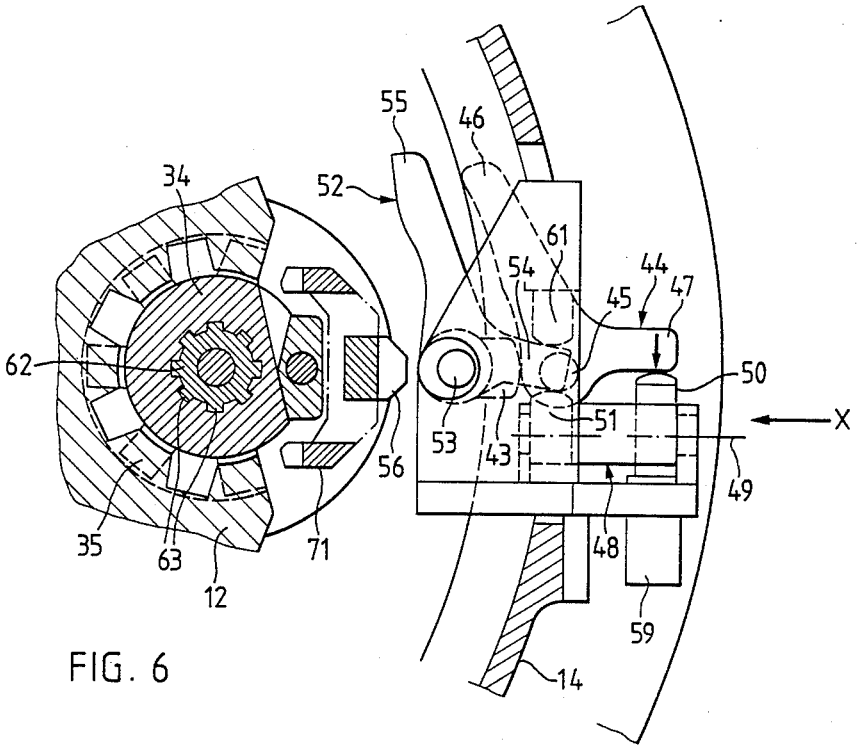
FIG. 6 is a section along the line VI—VI in FIG. 5.

However, as soon as the piston 41 is rearwardly displaced against the force of the spring 42 under the action of gas pressure, i.e. to the bottom as viewed in FIG. 5, then the cam or dog 43 is disengaged from the lever or lever member 44. As shown in FIG. 6, the lever 44 actually forms a first two-armed or double-arm lever 44 which is mounted for pivoting about a first axis or pivot shaft 45 in the weapon housing 14. A first arm 46 of this first two-armed or double-arm lever 44 is supported at the cam 43 of the piston 41. A second arm 47 of such first two-armed or double-arm lever 44 is supported at a second two-armed or double-arm lever 48 (see also FIG. 7). The second two-armed or double-arm lever 48 is mounted for pivoting about a second axis or pivot shaft 49 in the weapon housing 14. A first arm 50 of the second two-armed lever 48 is supported at the second arm 47 of the first two-armed lever 44. A second arm 51 of the second two-armed lever 48 is supported at a third two-armed or double-arm lever 52. This third two-armed or double-arm lever 52 is mounted for pivoting about a third axis or pivot shaft 53 in the weapon housing 14. A first arm 54 of the third two-armed lever 52 is supported at the second arm 51 of the second two-armed lever 48. A second arm 55 of the third two-armed lever 52 is supported at an actuating or actuation lever 56. The actuating lever 56 is mounted for rotation about an axis or pivot shaft 57 at the breechblock head 34. The breechblock head 34 can be decoupled from the breechblock carrier 33 by means of the actuating lever 56 in a manner as will be described more fully hereinbelow.

Figure 7:
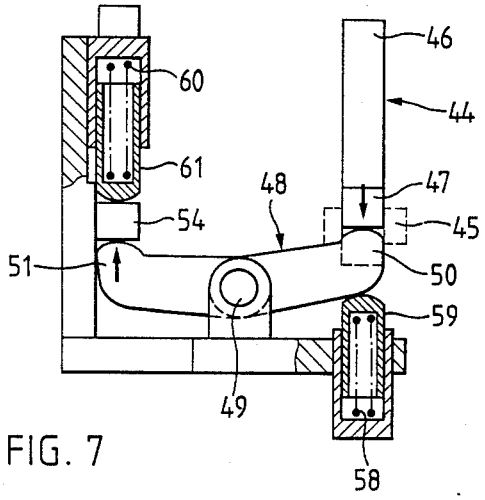
FIG. 7 is a view looking in the direction of the arrow X of FIG. 6.

As will be recognised from FIG. 7, a first spring 58 is arranged in the weapon housing 14 such as to be supported at the first arm 50 of the second two-armed or double-arm lever 48 via a first sleeve 59. Furthermore, a second spring 60 is arranged in the weapon housing 14 so as to be supported at the second arm 51 of the second two-armed lever 48 via a second sleeve 61 and the first arm 54 of the third two-armed or double-arm lever 52. As shown in FIG. 7, the first and second springs 58 and 60 tend to pivot the second two-armed lever 48 in a counterclockwise direction. As will be seen from FIG. 6, the first and second springs 58 and 60 also tend to pivot the first two-armed lever 44 likewise in counterclockwise direction, however, the third two-armed lever 52 in clockwise direction.

According to FIG. 5 of the drawings, an ignition or firing pin 65 is displaceably mounted in the breechblock carrier 33. A spring 66 is supported at one of its ends at the rear end of the ignition pin 65 and, at its other end, at the breechblock carrier 33. The spring 66 tends to thrust the ignition pin 65 against the bottom or base of the cartridge case 28. At the rear end of the ignition pin 65 there is further mounted an entraining member 67 which cooperates with any suitable not particularly shown cam plate. The ignition pin 65 is released by the cooperation of the entraining or entrainment member 67 and the cam plate (not shown) at the desired instant in order to penetrate into the cartridge 25.

Figure 8:
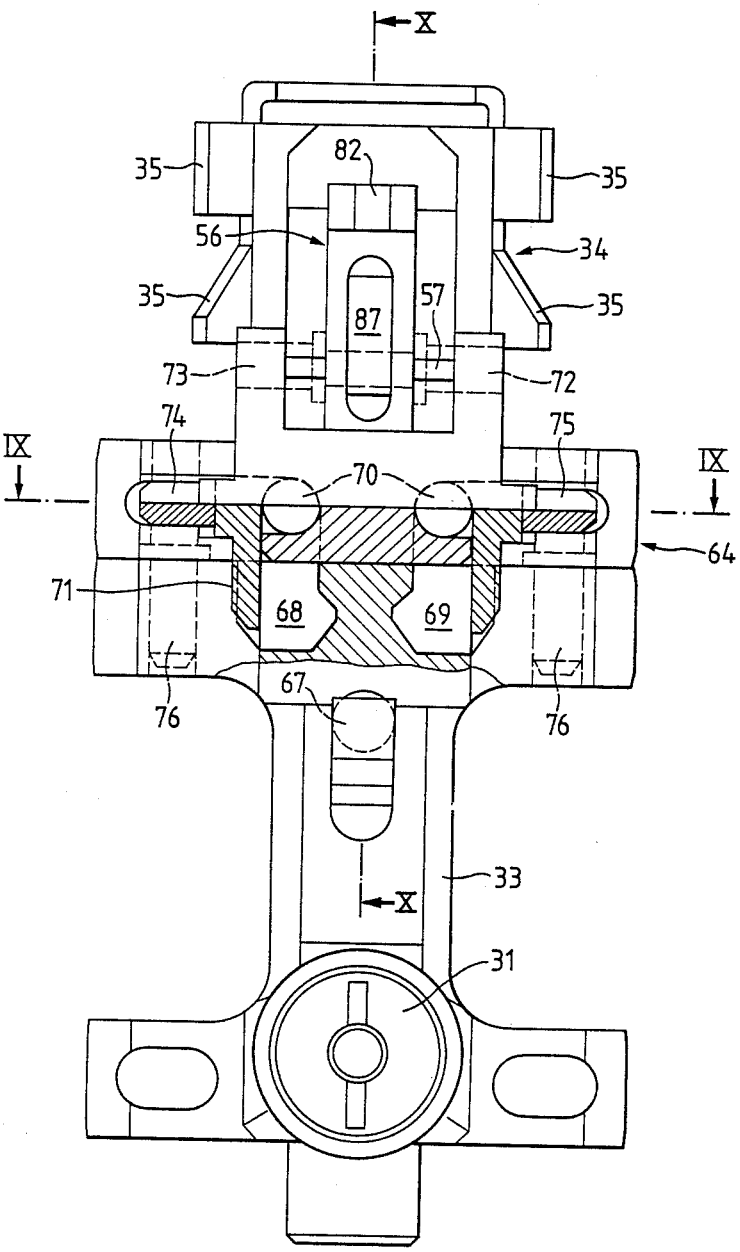
FIG. 8 is a top plan view of the breechblock illustrated in FIG. 3.
Figure 9:
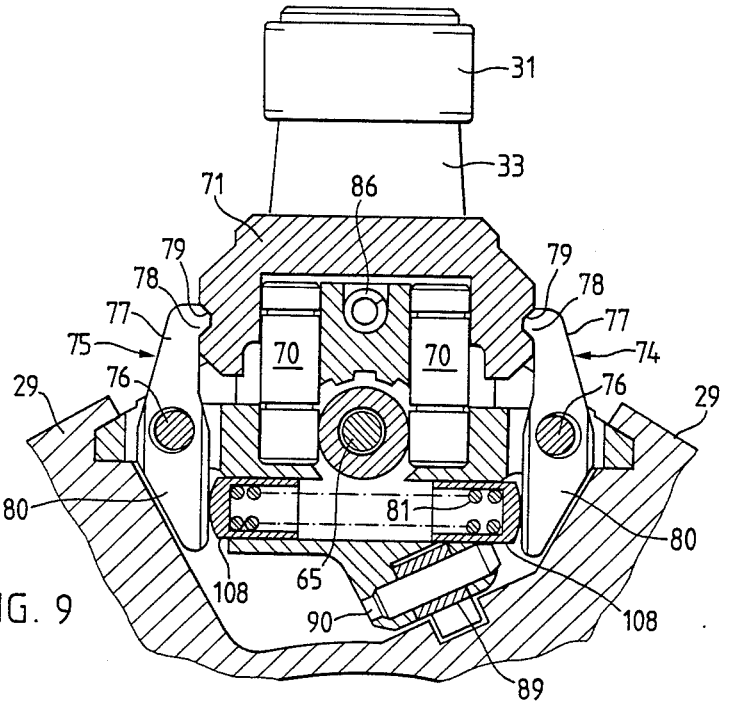
FIG. 9 is a section taken substantially along the line IX—IX in FIG. 8.

As will be evident from FIGS. 8 and 9 the breechblock head 34 and the breechblock head support 64 are coupled to rhe breechblock carrier 33 by means of two latches or locking elements 68 and 69. Bolts 70 are fixed to the latches 68 and 69 and are rotatably mounted at the breechblock head support 64. The two latches or locking elements 68 and 69 are held in their retaining position by means of a retaining bracket or bracket member 71 which is shown in cross-section in FIG. 9. Two bolts 72 and 73 are mounted at the retaining bracket 71 (see FIG. 8) and are also rotatably mounted in the breechblock head support 64. The retaining bracket 71 is held in the retaining or holding position as shown in FIGS. 8 and 9 by means of two levers 74 and 75 which are rotatable about bolts 76. These two levers 74 and 75 each comprise one arm 77 including a cam or dog 78 which engages with a related groove or recess 79 in the retaining bracket 71. A spring 81 reacts at the other arms 80 of the two levers 74 and 75 via respective sleeves 108. The spring 81 tends to press the cams or dogs 78 of the two levers 74 and 75 into the grooves or recesses 79 formed at the retaining bracket 71, in order to thus fix the retaining bracket 71 in its retaining or holding position.

The retaining bracket 71 is operated on by the actuating lever 56 which has been descr bed hereinbefore with reference to FIG. 5 and which is mounted for pivoting about the bolt 57. As will be evident from inspecting FIG. 10, the actuating or actuation lever 56 has a first arm 82 which cooperates with the second arm 55 of the third two-armed or double-arm lever 52 which has been discussed hereinbefore with reference to FIGS. 5 and 7. Furthermore, the actuating lever 56 comprises a second arm 83 which cooperates with a stop or impact member 84 formed at the retaining bracket 71. A third arm 85 of the actuating lever 56 is pressed against a slide 87 by means of a spring 86. A feeler or contact bolt 88 is mounted at rhe slide 87 and is thrust towards the bottom or base of the cartridge case 28 via the third arm 85 of the actuating lever 56 by means of the aforementioned spring 86, see FIG. 5. The second arm 83 of the actuating lever 56 engages with the stop 84 at the retaining bracket 71 only when two conditions are met. Firstly, the breechblock head support 64 will have to be in its forwardmost position, i.e. in the top position in FIG. 5. Secondly, a cartridge 25 will have to be present. As will be evident from FIG. 11, the slide 87 including the actuating lever 56 pivotably mounted thereto are forwardly displaced by the action of the spring 86, i.e. to the upper position as viewed in FIG. 11 when no cartridge 25 is present, and thus the second arm 83 of the actuating lever 56 is disengaged from the stop 84 at the retaining bracket 71.

Figure 10:
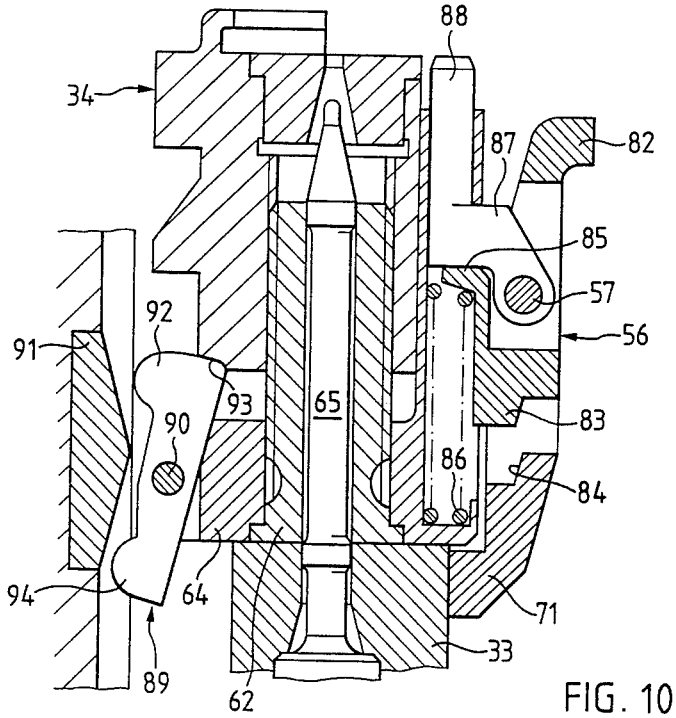
FIG. 10 is a longitudinal section through the front part of the breechblock illustrated in FIG. 8.

As shown in FIG. 10, a catch or detent pawl 89 is mounted for pivoting about an axis or pivot shaft 90 at the breechblock head support 64. The two-armed or double-arm catch or detent pawl 89 cooperates with a control cam 91 mounted at the related guide rail 29 of the rotor 12. This catch or detent pawl 89 has a first arm 92 which engages with a stop or impact member 93 formed at the breechblock head 34. It is prevented thereby that the locking member 62 which is mounted at the breechblock head support 64 (see FIG. 3) is completely pushed into the breechblock head 34 before the breechblock head 34 has reached its foremost position. As soon as a second arm 94 of the catch or detent pawl 89 abuts against the control cam 91, the catch or detent pawl 89 is pivoted in counterclockwise direction until the first arm 92 thereof is disengaged from the stop 93. When the breechblock head support 64 is withdrawn, then the first arm 92 of the catch or detent pawl 89 abuts against the control cam 91, and thus, the catch or detent pawl 89 is pivoted in clockwise direction into its initial position as shown in FIG. 10.

Figure 14:
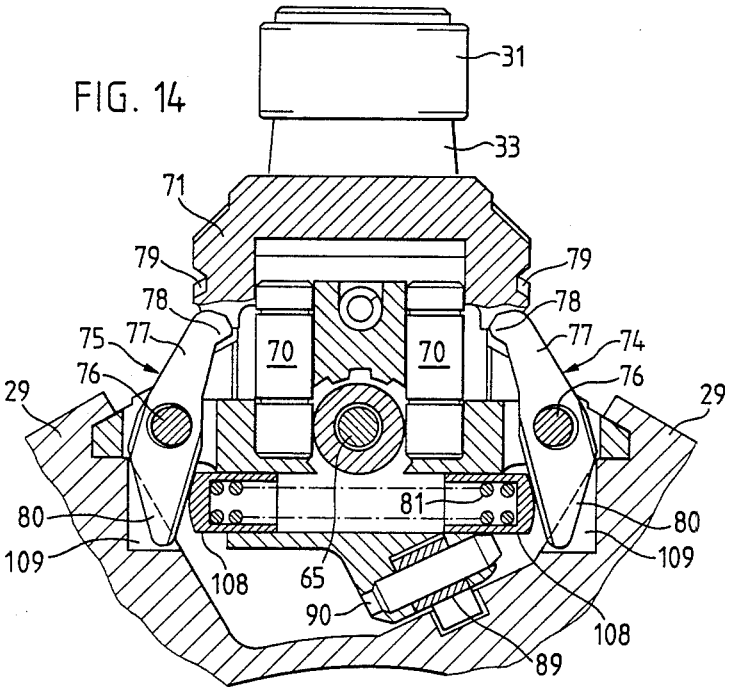
FIG. 14 is the same sectional view as in FIG. 9 and shows individual members of a breechblock head in the breechblock in different positions inan ignition delay condition.

As depicted in FIG. 14, the guide rails 29 contain recesses 109 which can be engaged by the second arms 80 of the levers 74 and 75, whereby the breechblock head 34 is secured against any kind of displacement.

Figure 15:
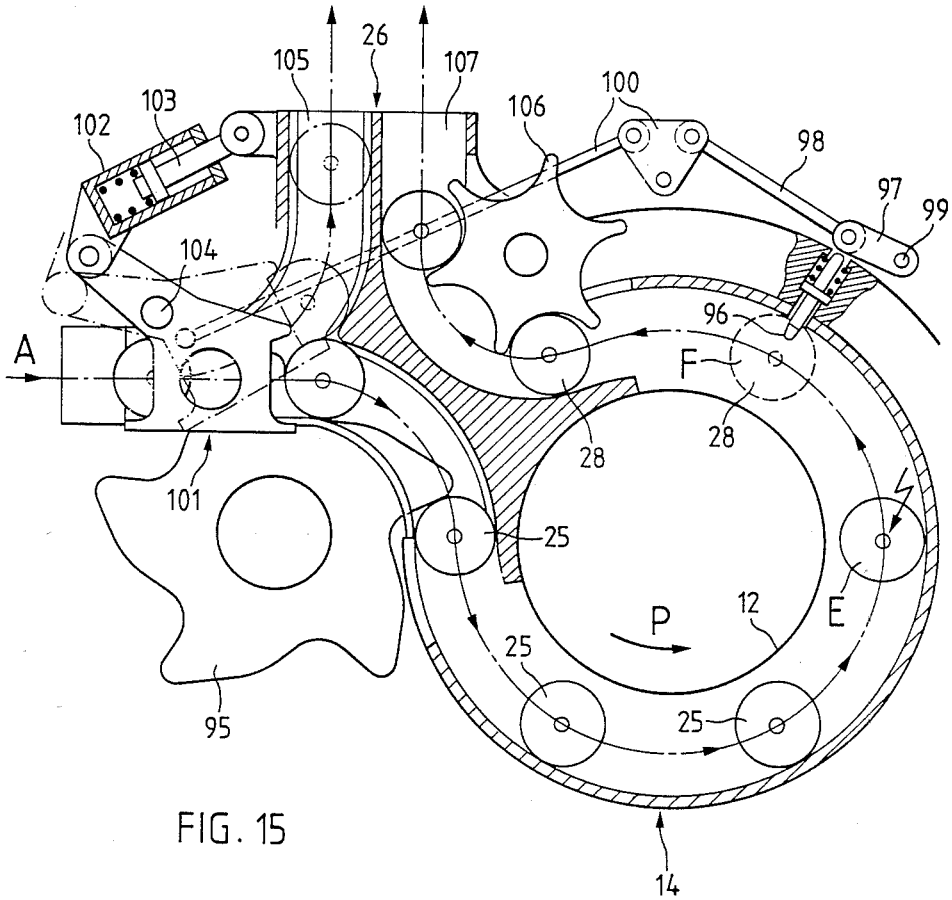
FIG. 15 is a cross-section through the weapon shown in FIG. 1 and serving to schematically illustrate the cartridge infeed and the cartridge case ejection.

Considering FIGS. 2 and 15 the cartridges 25 are fed to the weapon housing 14 and in front of or forwardly of the breechblocks 30 by means of a star wheel 95; in FIG. 15 for simplicity only the cartridges 25, but not the breechblocks 30 are illustrated. At the location E the cartridges 25 are penetrated by the ignition or firing pin 65. When delayed ignition or a hangfire condition occurs the cartridge 25 is not withdrawn from the weapon barrel 11 and passes to the location F during rotation of the rotor 12. At this location the cartridge case 28 which has remained in the weapon barrel 11 can be sensed by a feeler or contact bin 96. This feeler or contact pin 96 is displaceably mounted at the rotor 12 and can be radially outwardly displaced from the position as shown in such FIG. 15. Two rods 97 and 98 of a toggle joint or the like are supported at the feeler or contact pin 96. The rod 97 of the toggle joint is linked to the weapon housing 14 at its end 99. The rod 98 of the toggle joint is linked to a deflector or switching structure 101 via a linkage arrangement 100. A cylinder 102 is linked or hingedly connected to the deflector 101. A not particularly referenced spring-loaded piston, which is displaceable within the cylinder 102, is linked to the ammunition feed housing or body 26 by means of a piston rod 103 in such a manner that pressure is exerted on the deflector 101, so that the same is pivoted about an axis or pivot shaft 104 when the toggle joint or structure buckles and which is formed by the two toggle rods or levers 97 and 98. When the deflector 101 is pivoted about the axis or pivot shaft 104, the cartridges 25 which are supplied by the star wheel 95 in the cartridge infeed or feeding direction as indicated by the arrow A, are no longer delivered to the weapon housing 14, but are now passed immediately into a cartridge ejection channel 105 formed in the ammunition feed housing or body 26. The empty cartridge cases 28 are conveyed into an adjacent cartridge case ejection channel 107 by means of a further star wheel 106.

The mode of operation of the safety or anti-hangfire apparatus or equipment as described hereinbefore will now be considered and is as follows:

In accordance with FIGS. 1, 2 and 15 the cartridges 25 are supplied to the ammunition feed housing or body 26 of an ammunition supply device in the direction of the arrow A. The cartridges 25 are conveyed into the weapon housing 14 by means of the star wheel 95. Within the weapon housing 14 each cartridge 25 is engaged by a related breechblock 30 and rammed into a corresponding one of the weapon barrels 11. During this operation the rotor 12 rotates in the direction of the arrow P as indicated in FIG. 15. At the location E the breechblock 30 has arrived at its forwardmost position with the assistance of the control cam 32 and the cam follower roll 31 as will be evident from FIG. 2. In this position the cartridge 25 is penetrated by the ignition or firing pin 65 as shown in FIG. 5.

In the event that the propellant charge in the cartridge 25 is ignited in time, then the propellant gas enters the gas intake orifice 37, passes through the gas intake passage or channel 39 into the gas chamber 40, and thus the gas pressure operable piston 41 is displaced against the force of the spring 42 towards the rear, i.e. to the bottom in FIG. 5. Consequently, the cam 43 is disengaged from the first two-armed or double-arm lever 44, and thus, is not in a position to pivot in clockwise direction the first two-armed lever 44 shown in FIG. 6. As soon as the breechblock carrier 33 is moved to the rear again, then the breechblock held 34 is also withdrawn and the cartridge case 28 is withdrawn from the related weapon barrel 11. The empty cartridge case 28 is then ejected through the case ejection channel 107 by means or the star wheel 106 as will be evident from FIG. 15.

Figure 12:
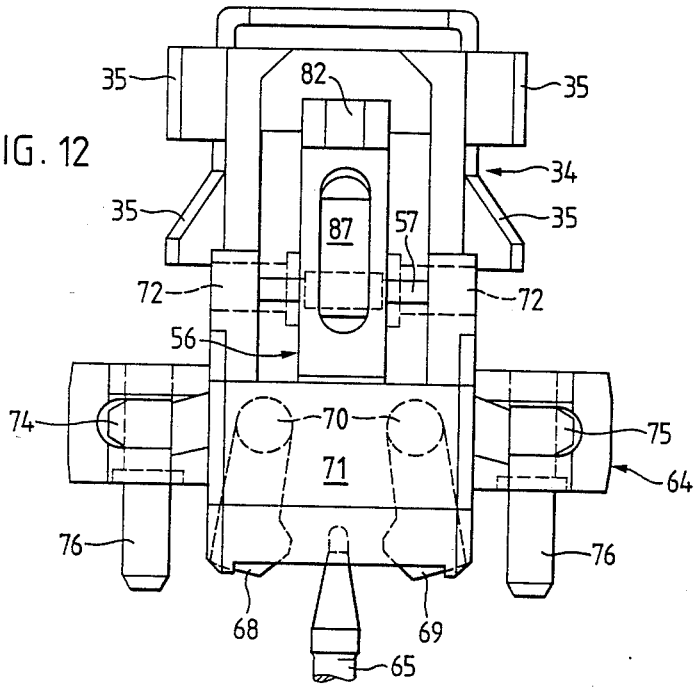
FIG. 12 is substantially the same top plan view as in FIG. 8 and shows the breechblock head of the breechblock in the decoupled position thereof.
Figure 13:
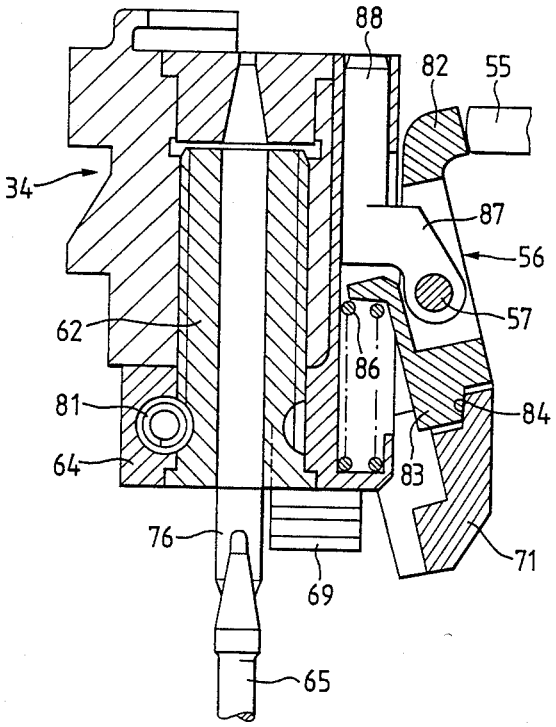
FIG. 13 is essentially the same longitudinal sectional view as in FIG. 11 and shows individual members of the breechblock head in different positions in an ignition delay condition.

However, in the case that the propellant charge in the cartridge 25 is not ignited in time when penetrated by the ignition or firing pin 65, then, of course, no propellant gas will enter the gas intake orifice 37, the gas intake passage or channel 39 and the gas chamber 40. Thus, importantly the gas pressure operable piston 41 is not displaced towards the rear, i.e. to the bottom as viewed in FIG. 5 against the force of the spring 42. The cam or dog 43 therefore now remains in the path of the first two-armed or double-arm lever 44. As will be evident from FIG. 6, this cam or dog 43 abuts the first arm 46 of the first two-armed lever 44, which is thus pivoted clockwise, when the rotor 12 rotates relative to the weapon housing 14. Due to this pivoting movement the second arm 47 of the first two-armed lever 44 pivots the second two-armed or double-arm lever 48 by means of the first arm 50, whereby the third two-armed or double-arm lever 52 is thus pivoted in counterclockwise direction, as will be evident from FIGS. 6 and 7. In accordance with FIG. 5, the second arm 55 of the third two-armed lever 52 pivots in counrerclockwise direction the actuating lever 56 of the breechblock 30. The actuating lever 56 will thus assume the position as shown in FIG. 13. The second arm 83 of the actuating lever 56 abuts the stop 84 formed at the retaining bracket 71 during this operation, whereby the retaining bracket 71 also is pivoted into the position shown in FIG. 13. The retaining bracket 71 thus no longer retains the latches 68 and 69 which can now assume a position as shown in FIG. 12. The breechblock head support 64 including the breechblock head 34 thus remains locked in the foremost or forwardmost position thereof when the breechblock carrier 33 is withdrawn and the latter solely moves to the rear as to the right as illustrated in FIG. 4.

Such decoupling of the breechblock head 34 from the breechblock carrier 33 in the manner as just described may only occur in the case of ignition delay or a hangfire condition, however, not at the start of series firing when no cartridge 25 is yet present in the weapon barrel 11 at the location E indicated in FIG. 15.

Figure 11:
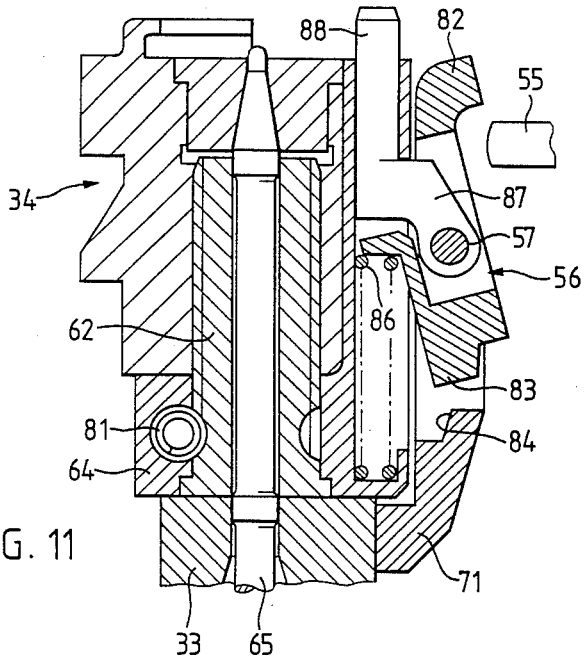
FIG. 11 is a longitudinal section, similar to that of FIG. 10, with individual members of a breechblock head in the breechblock in a different position when a cartridge is absent.

In accordance with FIG. 11 the feeler or contact bolt 88 is displaced towards the left in the absence of a cartridge 25. The second arm 83 of the actuating lever 56 is thereby disengaged from the stop or impact member 84 formed at the retaining bracket 71. Therefore, decoupling of the breechblock head 34 from the breechblock carrier 33, as illustrated in FIG. 4, is impossible in the absence of a cartridge 25. Furthermore, it should still be noted that in the absence of a cartridge 25, i.e. with the feeler or contact bolt 88 in its forwardly displaced position, the actuating lever 56 is also displaced to the left as viewed in FIG. 11 and thus no longer engages the second arm 55 of the third two-armed or double-arm lever 52. While the third two-armed lever 52 is operated in the absence of gas pressure and in the absence of a cartridge 25, however the same cannot in any way pivot the actuating lever 56 under these conditions since the latter no longer engages the second arm 55 of the third two-armed lever 52 as also evident from FIG. 11.

In the case of an ignition delay or a hangfire condition the breechblock head 34 which nas been separated from the breechblock carrier 33 must no longer move. By pivoting the retaining bracket 71 into the position as illustrated in FIGS. 13 and 14, the cams or dogs 78 of the two levers 74 and 75 no longer engage the grooves or recesses 79 in the retaining bracket 71 and thus are pivoted into the position shown in FIG. 14 under the force of the spring 81. By virtue of such pivoting movement the arms 80 of these two levers 74 and 75 enter the recesses 109 in the guide rails 29 and thereby any displacement of the breechblock head 34 is prevented.

When the rotor 12 is further rotated in the direction of the arrow P (see FIG. 1), the cartridge 25 which has not been ignited or fired at the location E, due to the mentioned ignition delay or a hangfile condition, passes to the location F. Since, as described hereinbefore, this cartridge has not been removed from the weapon barrel 11 due to the ignition delay or hangfire condition, the non-ignited cartridge 25 abuts the feeler or contact pin 96. The toggle joint formed by the rods or levers 97 and 98 is thus buckled, whereby the deflector or switching structure 101 is pivoted about its axis or pivot shaft 104. The cartridges supplied in the direction A therefore no longer enter the weapon housing 14, but are now passed into the cartridge ejection channel 105. The cartridge supply to the weapon is thus interrupted.

Figure 16:
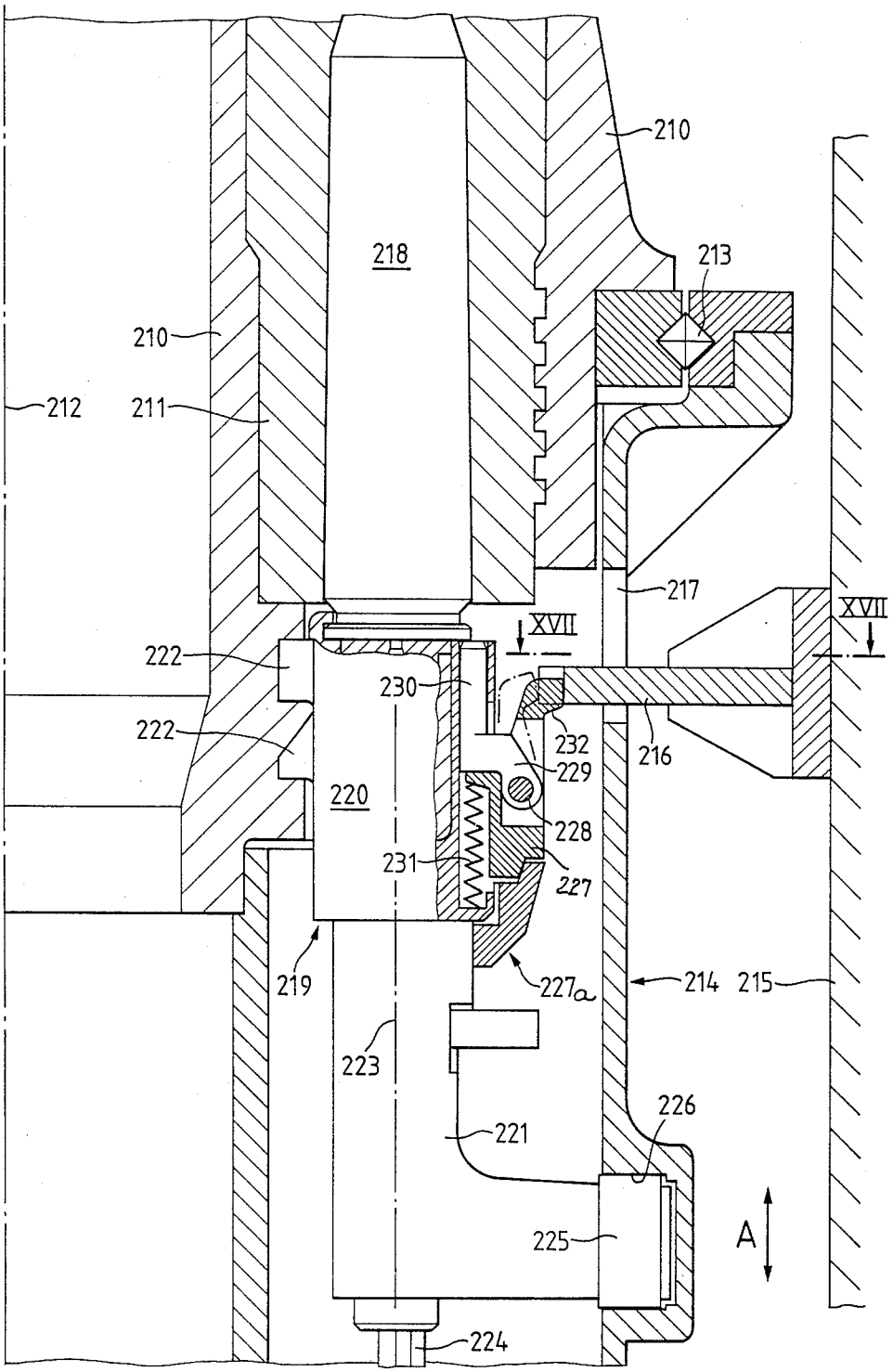
FIG. 16 is a radial section through part of a firing weapon including the rear end of a weapon barrel and a breechblock and incorporating a second embodiment of the safety apparatus or equipment according to the invention.

A weapon arrangement incorporating a second embodiment of the safety apparatus or equipment according to the invention, but which responds to the weapon recoil is illustrated by FIGS. 16 and 17. As shown in FIG. 16, a weapon barrel 211 is mounted at a rotor 210. The rotor 210 is rotatable about a lengthwise axis 212. In addition to the weapon barrel 211 which is visible in FIG. 16, it will be understood that the rotor 210 additionally contains five further weapon barrels which, however, are not shown in the drawing of FIG. 16. These six weapon barrels 211 are arranged substantially parallel to the lengthwise axis 212 and are essentially uniformly distributed along the circumference of a circle. The rotor 210 is rotatably journaled in a weapon housing 214 by means of a bearing 213. This weapon housing 214 is displaceably mounted in conventional manner at a cradle 215 which permits recoil of the weapon or weapon system. The cradle 215 is conveniently indicated in FIG. 16 by a single line. The direction of displacement of the weapon relative to the cradle 215 is indicated by a bidirectional arrow A. A cam plate 216 is fixed to the cradle 215, see also FIG. 17, and this cam plate 216 protrudes through an opening 217 into the interior of the weapon housing 214. This opening 217 is sufficiently large so that, when the weapon housing 214 is displaced relative to the cradle 215, the cam plate 216 cannot abut the margin or boundary walls of the opening 217.

A cartridge 218 is located in the weapon barrel 211. When the cartridge 218 is fired, the weapon housing 214 is displaced from the position shown in FIG. 16 towards the bottom as viewed in such FIG. 16. A breechblock 219 of the firing weapon is located to the rear of the weapon barrel 211 and its breech and possesses a breechblock head 220 and a breechblock carrier 221. The breechblock head 220 possesses a number of locking cams or dogs 222 of which only two are particularly visible in FIG. 16. The breechblock head 220 can be locked in the rotor 210 by rotation about a breechblock axis 223 in the manner of a bayonet lock by means of the locking cams or dogs 222. The locked position of the breechblock 219 is shown in FIG. 16. The breechblock carrier 221 is displaceably mounted on the guide rails 224 in the rotor 210. A cam follower roll 225 is rotatably mounted at the breechblock carrier 221. The cam follower roll 225 is located within a substantially elliptical control cam 226 of the substantially cylindrical weapon housing 214. Due to the action of the control cam 226 the breechblock carrier 221 is reciprocated in the direction of the bidirectional or double-headed arrow A, when the rotor 210 is rotated about the axis 212 in the weapon housing 214.

As shown in FIG. 16, the breechblock carrier 221 including the breechblock head 220 are located in their forwardmost position. The breechblock head 220 and the breechblock carrier 221 are appropriately coupled to each other. For decoupling the breechblock carrier 221 from the breechblock head 220 an actuating mechanism is provided which comprises a two-armed or double-arm actuating lever 227 which is mounted for pivoting about an axle or pivot shaft 228 and cooperates with a retaining bracket 227*a*. The axle or pivot shaft 228 is fixed via an arm 229 to a feeler or contact bolt 230 which is displaceably mounted in the breechblock head 220. A spring 231 tends to press the feeler or contact bolt 230 against the bottom end or base of the cartridge 218. The front end 232 of the two-armed or double-arm actuating lever 227 cooperates with the previously described cam plate 216 which is mounted to the cradle 215, when the weapon housing 214 is in the position as shown in FIG. 16 and as will be also specifically evident from FIG. 17. The cam plate 216, which is mounted at the cradle 215, protrudes into the interior of the weapon housing 214 through the opening 217, see also FIG. 17. When the rotor 210 rotates about the lengthwise axis 212 in the weapon housing 214 (see FIG. 16), then the two-armed actuating lever 227 including its front end 232 is displaced in the direction of the arrow B as indicated in FIG. 17.

The mode of operation of the second embodiment of safety apparatus or equipment as described hereinbefore is as follows:

It may be assumed that the firing weapon into which there is incorporated the safety apparatus or equipment as described hereinbefore is in its series firing mode. Under such conditions the rotor 210 rotates in the weapon housing 214 about the axis 212 in the direction of the arrow B (see FIG. 17). Under the recoil action the weapon housing 214 is displaced relative to the cradle 215 to the bottom viewed in FIG. 16 to such an extent that the front end 232 of the two-armed or double-arm actuating lever 227 is disengaged from the cam plate 216 which is mounted at the cradle 215. This cam plate 216 thus cannot operate upon the actuating lever 227 and the breechblock head 220 remains coupled to the breechblock carrier 221. Thus, the breechblock 219 is completely reciprocated or moved back-and-forth once for each revolution of the rotor 210 and hence pushes a further cartridge 218 into the weapon barrel 211 during such operation after the empty cartridge case of the preceding cartridge 218 has been ejected. However, as soon as a cartridge 218 fails to ignite on time due to the presence of an ignition delay or a hangfire condition, then the breechblock head 220 must not be returned or retracted. After the occurrence of an ignition delay or a hangfire condition, such return movement of the breechblock head 220 is effectively prevented in tne manner as described hereinbelow:

In the case of an ignition delay or a hangfire condition the recoil of the firing weapon does not occur and the weapon housing 214 is therefore located to the rear due to the action of the preceding fired round. The weapon housing 214 will now forwardly move relative to the cradle 215, i.e. to the top in FIG. 16, to such an extent that the front end 232 of the two-armed or double-arm actuating lever 222 engages with the cam plate 216. As will be evident from FIG. 17, the front end 232 of the actuating lever 227 is radially inwardly urged in accordance with the shape of the cam plate 216, when the rotor 210 is rotated in the direction of the arrow B. In accordance with FIG. 16 the actuating lever 227 is thus pivoted in counterclockwise direction about its axle or pivot shaft or pin 228. The breechblock 219 is thereby decoupled, i.e. the breechblock head 220 remains in the top or foremost or forwardmost position, while solely the breechblock carrier 221 without the breechblock head 220 is rearwardly displaced, i.e. to the bottom as viewed in FIG. 16 because the cam follower roll 225 is guided by the control cam 226. In the event that the cartridge 218 is still belatedly ignited, there is thus nonetheless ensured that the breechblock head 220 is still located in the forwardmost and locked position. As soon as the breechblock 219 is decoupled, the weapon is shutdown by means of any suitable shutdown device and the motor 210 is stopped.

Figure 18:
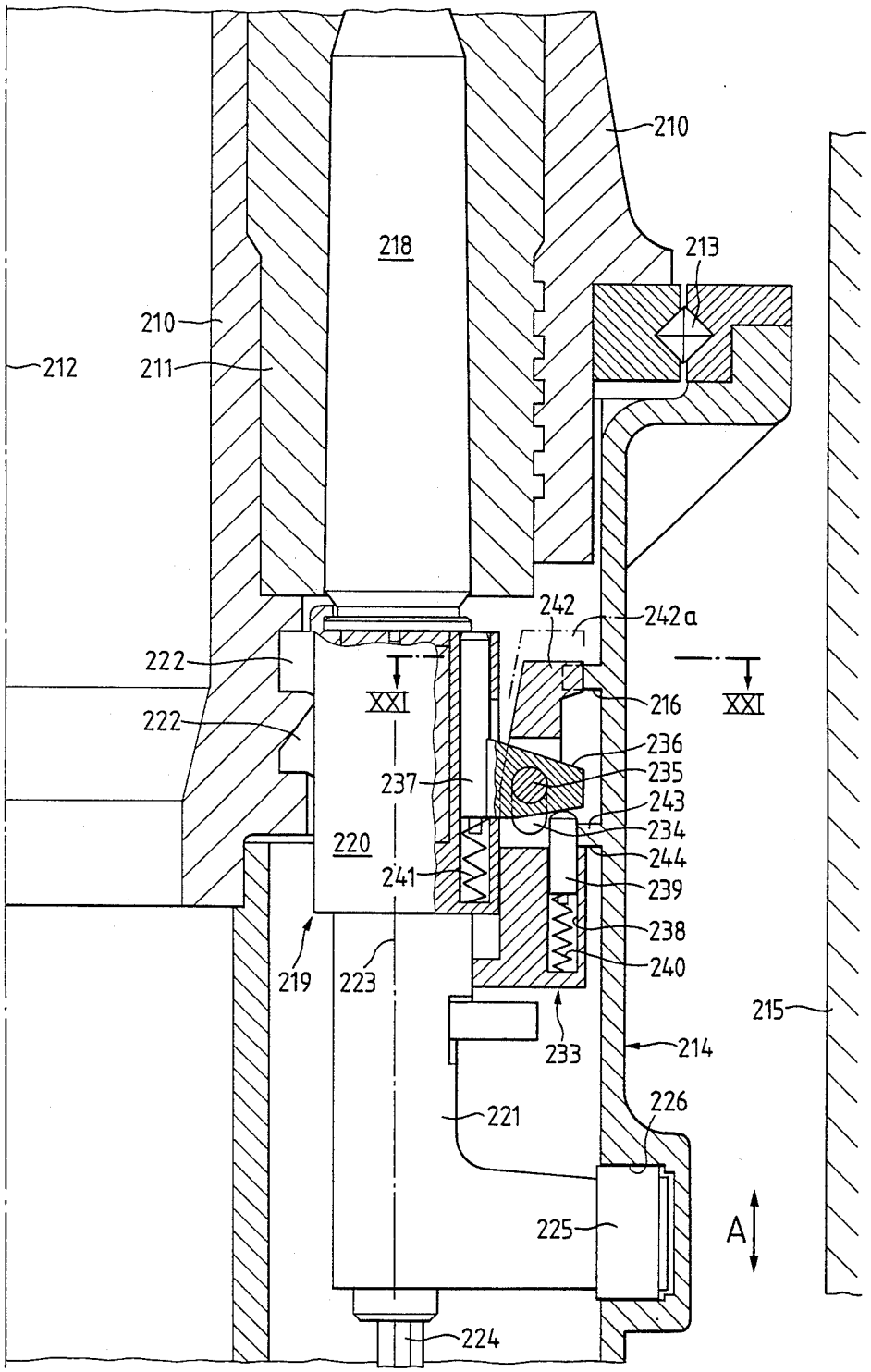
FIG. 18 is a radial section through part of a firing weapon including the rear end of a weapon barrel and a breechblock and incorporating a third embodiment of the safety apparatus or equipment according to the innvention.

A third safety or anti-hangfire apparatus or equipment which also responds to the weapon recoil is shown in FIGS. 18 and 21 in conjunction with a weapon into which it is incorporated. Members or parts in this third embodiment which are the same or analogous to members or parts of the second embodiment illustrated by FIGS. 16 and 17 are here likewise generally designated by the same reference characters and are thus not further described herein in any particular detail. This third embodiment does not include a cam plate which is mounted to the cradle 215. Instead a first plate 216 is mounted at the weapon housing 214, so that there is not required any opening in the weapon housing 214 through which the cam plate 216 can protrude. During the recoil of the weapon or weapon system the first cam plate 216 also reciprocates in the direction of the bidirectional or double-headed arrow A. This first cam plate 216 serves to operate an actuating mechanism which comprises a two-armed or double-arm actuating lever 233 which forms an inertia mass and which contains an elongated hole or slot 234. An axle or pivot pin 235 which is fixed to a feeler or contact pin 237 via an arm 236, extends through the elongated hole or slot 234. This feeler or contact bolt 237 is displaceably arranged in the breechblock head 220. A spring 241 urges such feeler or contact bolt 237 against the bottom end or base of a cartridge 218.

In a bore 238 formed in the two-armed actuating lever or inertia mass 233 there is located a pin 239 which is urged towards the arm or arm member 236 by means of a spring 240. This two-armed actuating lever or inertia mass 233 is thus displaced to the top as viewed in FIG. 18 until the axle or pivot pin 235 abuts the top end of the elongated hole or slot 234. The top end 242 of the two-armed actuating lever or inertia mass 233 is located in the initial position as shown, i.e. in a position within the operable range of the first cam plate 216 prior to firing of the cartridge 218. The first cam plate 216 of this third embodiment of the safety or anti-hangfire apparatus as presently described possesses the same shape as the cam plate 216 of the previously described second embodiment which is mounted to the cradle 215 as will be evident by comparison of FIGS. 17 and 21. A second cam plate 243 is mounted at the weapon housing 214 as will be evident from FIGS. 18 and 21. The two-armed actuating lever or inertia mass 233 contains a stop or impact member 244 which engages with the second cam plate 243. Thus, the two-armed actuating lever or inertia mass 233 cannot be displaced to the top from the position illustrated in FIG. 18 at the region of the second cam plate 243.

The mode of operation of this third embodiment of safety or anti-hangfire apparatus as illustrated in FIGS. 18 and 21 will now be described.

It is again assumed that the firing weapon equipped with the third embodiment of safety apparatus also is in its series firing mode. The rotor 210 rotates about the lengthwise axis 212 in the direction of the arrow B (see FIG. 21) in the weapon housing 214 and the latter is displaced to the bottom as viewed in FIG. 18 relative to the cradle 215 under the recoil action of the weapon. Due to its inertia the two-armed actuating lever or inertia mass 233 remains, in its initial position, i.e. is displaced to the top relative to the breechblock head 220. The front end 242 of the two-armed actuating lever or inertia mass 233 thus passes into the position **242*a* which is shown in dash-dotted lines and thereby disengages from the first cam plate 216 mounted at the weapon housing 214. The first cam plate 216 thus cannot operate upon the two-armed actuating lever or inertia mass 233, so that the breechblock carrier 221 remains coupled to the breechblock head 220. The breechblock 219 completely reciprocates or moves back-and-forth once per each revolution of the rotor 210 and, by means of this operation, pushes another cartridge 218 into the weapon barrel 211 after the empty cartridge case of the previously fired cartridge has been ejected. However, as soon as a cartridge 218 does not ignite on time due to ignition delay or a hangfire condition, then the breechblock head 220 must no longer be returned or retracted. The return movement of the breechblock head 220** after encountering an ignition delay or a hangfire condition is prevented in the manner as will be now described hereinbelow:

In the case of an ignition delay or a hangfire condition the recoil of the firing weapon does not occur and neither does the relative displacement of the two-armed actuating lever or inertia mass 233 relative to the breechblock head 220 as just described hereinbefore. Therefore, the front end 242 of the two-armed actuating lever or inertia mass 233 now engages with the first cam plate 216, so that the breechblock 219 is decoupled as described hereinbefore with reference to the second embodiment illustrated by FIGS. 16 and 17 of the drawings. The second cam plate 243 ensures that the two-armed actuating lever or inertia mass 233 is located in its initial position as shown in FIG. 18 prior to the firing of a round. When the round is fired, however, this second cam plate 243 is no longer in engagement with the stop or impact member 244 at the two-armed actuating lever or inertia mass 233.

Figure 19:
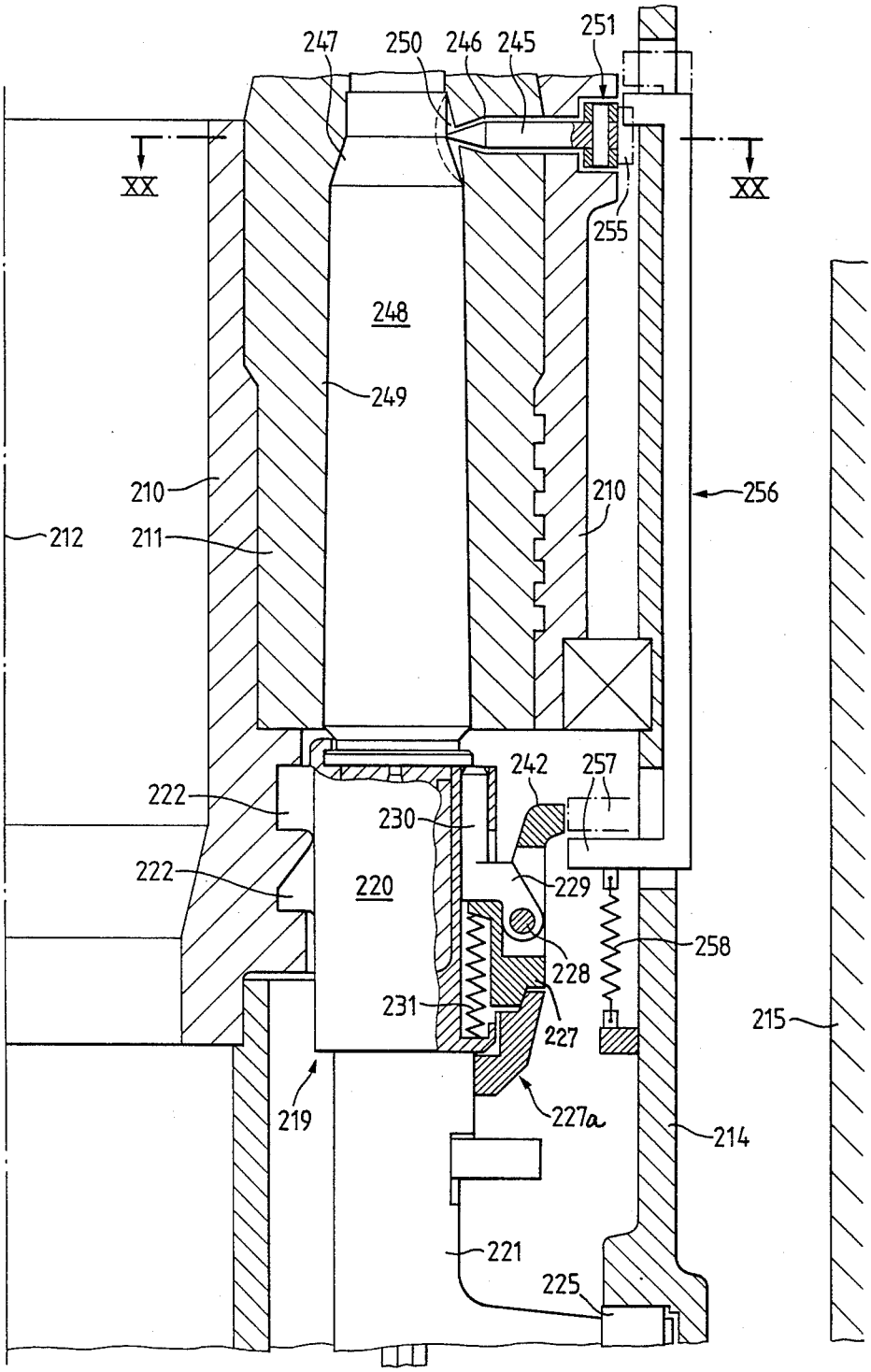
FIG. 19 is a radial section through part of a firing weapon including the rear end of a weapon barrel and a breechblock and incorporating a fourth embodiment of the safety apparatus or equipment according to the invention.
Figure 20:
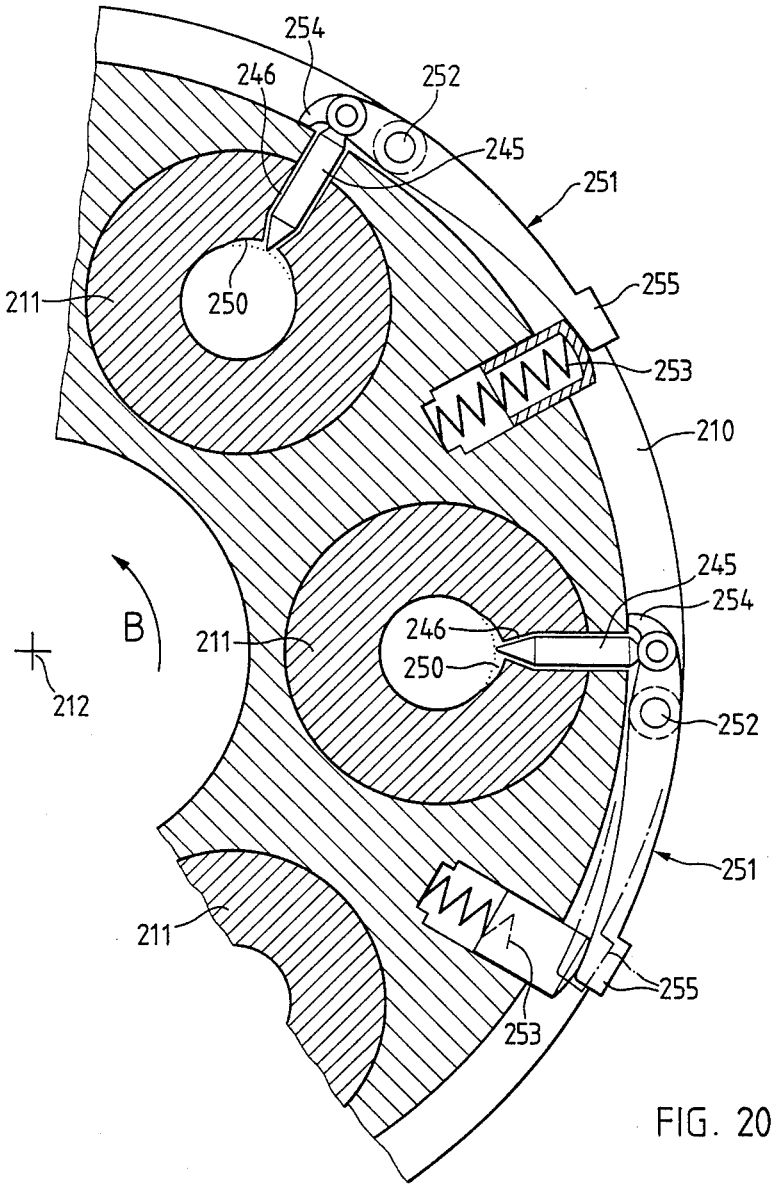
FIG. 20 is a cross-section along the line XX—XX in FIG. 19.

A fourth embodiment of safety or anti-hangfire apparatus according to the invention is shown in FIGS. 19 and 20 in conjunction with a weapon or weapon system into which it is incorporated. This fourth exemplary embodiment differs from the second and third embodiments as heretofore described with reference to FIGS. 16, 17, 18 and 21 by the features which are described hereinafter. Again, members or parts of the fourth embodiment of the inventive safety or anti-hangfire apparatus which are identical or analogous to corresponding members or parts of the second and third embodiments are generally designated by the same reference characters.

In the rotor 210 there is provided a feeler or contact element 245 for each weapon barrel 211. These feelers or contact elements 245 are displaceably mounted and two of them are visible in FIG. 20 while only one such feeler or contact element 245 is visible in FIG. 19. Each feeler or contact element 245 protrudes through a cross or transverse bore 246 provided in the weapon barrel and is supported at a conical portion or region 247 of a cartridge case or sleeve 248. The cartridge case 248 is located in a loading or charging chamber 249 of the weapon barrel 211. The charging chamber 249 has a recess 250 at the region of the feeler or contact element 245. Due to the recess 250 formed in the loading or charging chamber 249, the cartridge case 248 no longer engages with the wall of the charging chamber 249 in the weapon barrel 211 at this location. Thus, there is a space present between the cartridge case 248 and the wall of the loading or charging chamber 249. Upon firing the cartridge, the cartridge case 248 can be expanded or enlarged by the gas pressure and is thus pressed into the recess or depression 250. The feeler or contact element 245 protruding into such recess 250 is thus displaced. As shown in FIG. 20, the feeler or contact element 245 is pivotably connected or linked to a two-armed or double-arm lever 251 which is mounted for pivotal movement about an axis or pivot shaft 252 in the rotor 210.

A number of springs 253 are arranged in the rotor 210. Each of these springs 253 is operatively associated with a respective two-armed lever 251. Each spring 253 tends to pivot in counterclockwise direction the related two-armed lever 251 and to push the feeler or contact element 245 into the recess 250 and thus against the conical or tapered portion 247 of the cartridge case 248. The pivoting movement is limited by a stop or abutment 254 formed at the left-hand arm of the two-armed or double-arm lever 251. At the right-hand arm of such two-armed lever 251 there is arranged a cam or dog 255 which cooperates with an actuating mechanism comprising a slide bar or slide member 256. This slide bar or slide member 256 is mounted in the weapon housing 214 for displacement in axial direction. When the slide bar or member 256 abuts the aforementioned cam or dog 255 at the two-armed lever 251, then the slide bar 256 is held in the displaced position at the top as viewed in FIG. 19. This slide bar or member 256 comprises, at the bottom end thereof, a cam plate 257 which is structured like the cam plate 216 of the second and third embodiments and which cooperates with an actuating lever 227 of the type as already described with reference to the second embodiment illustrated in FIGS. 16 and 17. The slide bar or member 256 can be displaced by the cam or dog 255 on the two-armed lever 251 from the bottom full line position into the top phantom line position. A spring 258 tends to draw the slide bar 256 back into the bottom position. The breechblock 219 is essentially of the same construction as already described with reference to FIG. 16 and, therefore, is not here further described in any particular detail.

The mode of operation of this fourth embodiment of inventive safety or anti-hangfire apparatus as illustrated by FIGS. 19 and 20 is as follows:

It is again assumed that the firing weapon into which the safety or anti-hangfire equipment is incorporated also is in its series firing mode. Thus, the rotor 210 in the weapon housing 214 rotates about the lengthwise axis 212 in the direction of the arrow B, see also FIG. 20. Upon firing the cartridge the cartridge case 248 is expanded at its conical or tapered portion 247 due to the action of gas pressure. The feeler or contact element 245 is thus radially outwardly displaced as apparent from FIG. 20. Due to such radial displacement, the two-armed or double-arm lever 251 is pivoted clockwise into the position as shown in dash-dotted or phantom lines. Thus, the cam or dog 255 is also radially inwardly pivoted against the force of the related spring 253. As a consequence, the cam or dog 255 is disengaged from the slide bar or member 256 which, therefore, remains in the bottom position under the force of the spring 258. The actuating lever 227, which cooperates with the retaining bracket 227*a*, cannot be operated and the breechblock head 220 is thus not decoupled from the breechblock carrier 221. When an ignition delay or a hangfire condition occurs, then the feeler or contact element 245 remains in the position as shown in FIGS. 19 and 20, and thus, the two-armed lever 251, also, is not pivoted from its position. The cam or dog 255 remains, therefore, at the region of the slice bar or member 256 and displaces the latter towards the top whereby the cam plate 257 moves into the operable range of the actuating lever 227. As soon as the front end 242 thereof abuts the cam plate 257, then the actuating lever 227 is pivoted in counterclockwise direction and the breechblock 219 is decoupled, i.e. the breechblock carrier 221 is separated from the breechblock head 220.

Figure 22:
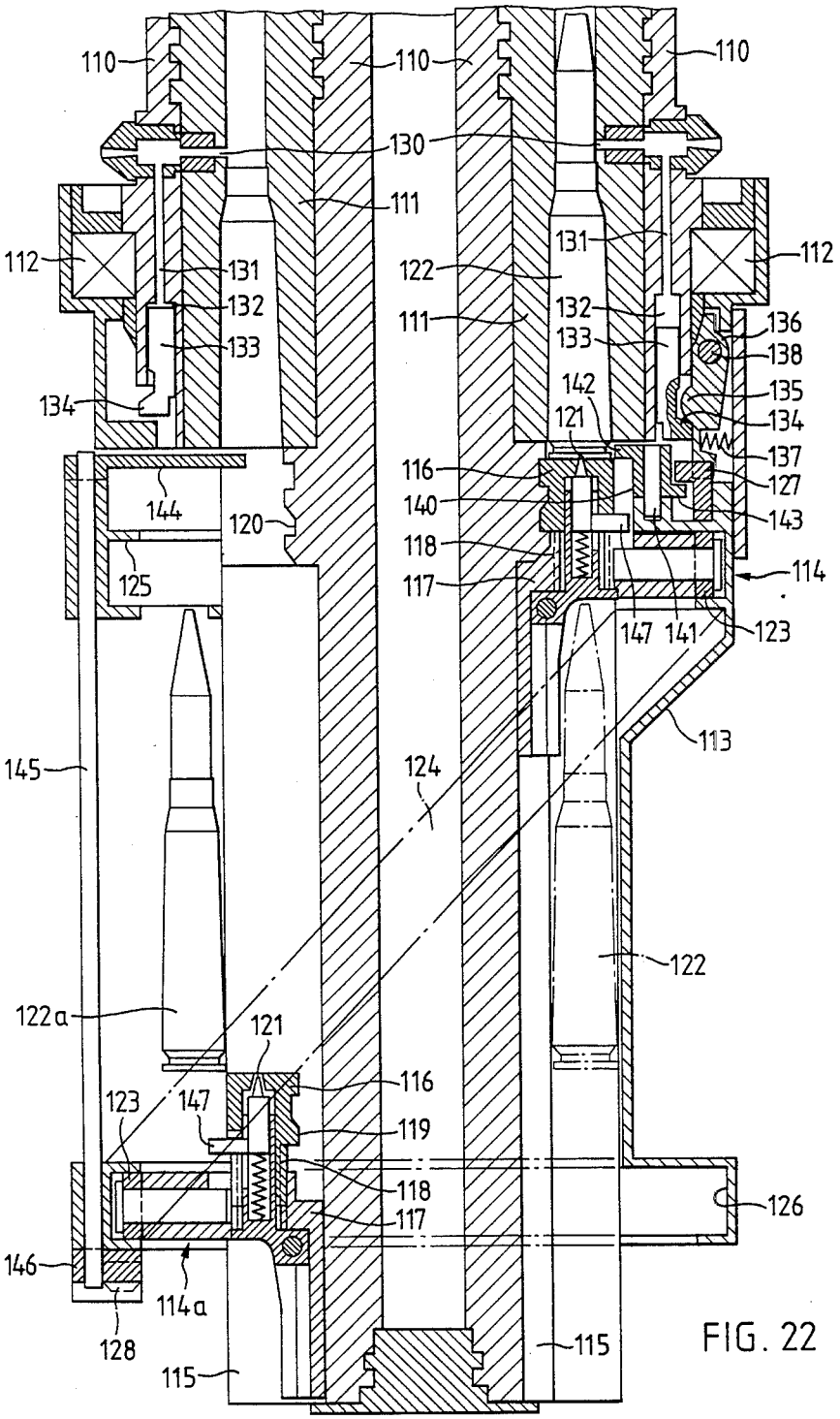
FIG. 22 is a longitudinal section through part of the firing weapon as illustrated in FIG. 16 and incorporating a fifth embodiment of the safety apparatus or equipment according to the invention.
Figure 26:
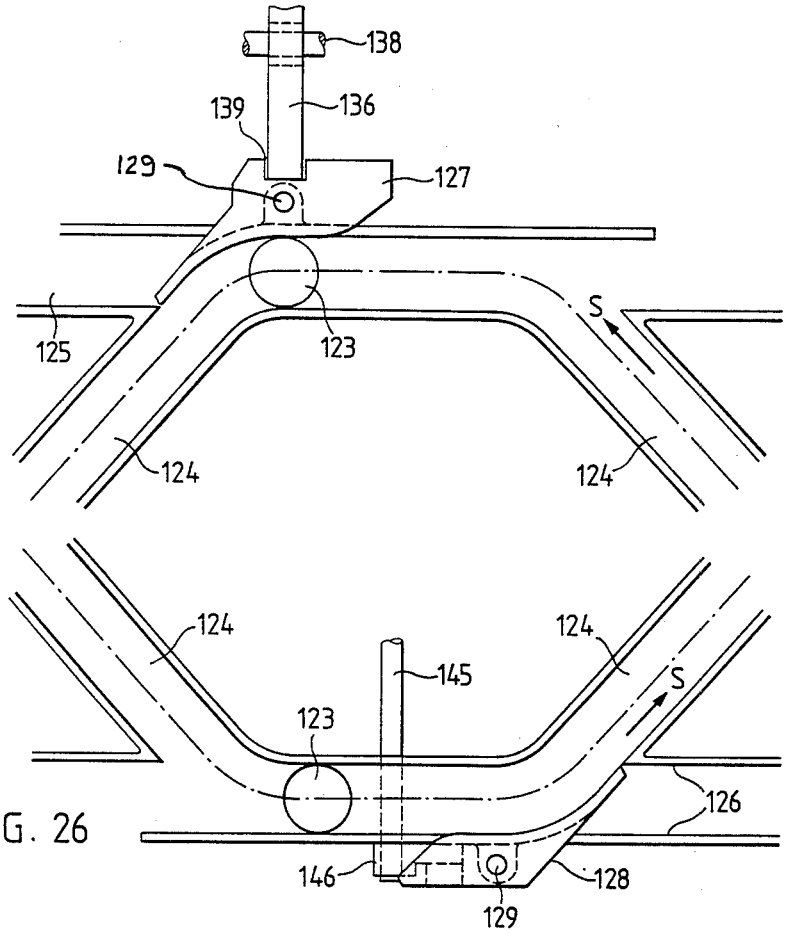
FIG. 26 is a development view of parts of the control cam shown in FIG. 22.

A fifth embodiment of the safety or anti-hangfire apparatus or equipment according to the invention is illustrated in FIGS. 22 and 26. The weapon contains a rotor 110 to which six weapon barrels 111 are readily or easily releasably mounted in the usual manner. Of these six weapon barrels 111 only two are illustrated in FIG. 22. The rotor 110 is rotatably journaled in a weapon housing 113 by means of a bearing 112. A number of breechblocks 114 are provided and each one of these breechblocks 114 is operatively associated with a respective weapon barrel 111. Each breechblock 114 is displaceably mounted in the rotor 110 at longitudinal guide members or guides 115. Two breechblocks 114 are illustrated in FIG. 22, one of which is shown to be located in its forwardmost and locked position while the other one is shown to be located in its rearmost and unlocked position. Each breechblock 114 comprises a breechblock head 116 and a breechblock head support 117. The breechblock head 116 and the breechblock head support 117 collectively form a rotary breechblock of known structure in which the breechblock head 116 is connected to the breechblock head support 117 by a screw thread 118 of steep pitch. The breechblock head 116 comprises locking cams or dogs 119 which engage with recesses 120 in the rotor 110 when the breechblock 114 is locked in its foremost or forwardmost position. The breechblock 114 further comprises a spring-loaded ignition or firing pin 121 which may penetrate into a cartridge 122 located in the weapon barrel 111, when the breechblock 114 is in its forwardmost and locked position. The breechblock 114 further possesses a cam follower roll 123 which engages with a first control cam 124 in the weapon housing 113. This first control cam 124 acts to reciprocate the individual breechblocks 114 when the rotor 110 is rotated in the weapon housing 113. Such first control cam 124 is of substantially elliptical shape and is arranged at the inside of the substantially cylindrical weapon housing 113.

Additionally, a second control cam 125 and a third control cam 126 are present at the front end and at the rear end, respectively, of the weapon housing 113. These second and third control cams 125 and 126 are of substantially circular shape and are arranged at the inside of the weapon housing 113. When the cam follower roll 123 of a breechblock 114 engages with one of the second or third control cams 125 or 126, then the breechblock 114 is not displaced when the rotor 110 is rotated in the weapon housing 113. The breechblock 114 remains in its forwardmost position when the cam follower roll 123 is located in the second control cam 125. The breechblock 114 remains in its rearmost or rear position, when the cam follower roll 123 is located in the third substantially circular-shaped control cam 126 of the weapon housing 113. Respective deflectors or switching elements 127 and 128 are present to enable the cam follower roll 123 to pass from the first elliptical control cam 124 into either the second control cam 125 or the third control cam 126.

According to the illustration of FIG. 26 of the drawings, the two deflectors or switching elements 127 and 128 are each mounted for pivotal motion about a related pivot axis or shaft 129. The cam follower roll 123 is shown to move in the first control cam 124 in the direction of the arrow S. When the deflectors 127 and 128 are in the positions as shown, the cam follower roll 123 thus continuously remains in the first elliptical control cam 124. The elements to be described hereinafter serve to operate the deflectors or switching elements 127 and 128.

As will be evident from FIG. 22, each weapon barrel 111 comprises a gas intake orifice or opening 130 through which propellant gas may enter a gas chamber 132 through a gas intake passage or channel 131. A gas pressure operable piston 133 is located within the gas chamber or compartment 132 and assumes the position as shown in the upper half of FIG. 22 under the action of gas pressure. The gas pressure operable piston 133 comprises a cam 134 which cooperates with another cam 135 of a blocking lever 136 which is part of an actuating mechanism. This blocking lever 136 is loaded by a spring 137 which urges such blocking lever 136 including its cam 135 towards the cam 134 at the gas pressure operable piston 133. The blocking lever 136 is mounted for pivotal movement about a pivot axis or shaft 138. As will be evident from FIG. 26, the blocking lever 136 engages with a recess 139 provided at the deflector 127. In the position as shown the blocking lever 136 thus prevents the deflector 127 from pivoting out of the position as shown.

A first sensing lever 140 is mounted for pivotal motion about an axis or pivot shaft 141 in the weapon housing 113 to ensure that the deflector 127 cannot be pivoted from the position as shown when no cartridge 122 is present. The first sensing lever 140 comprises a first arm 142 which senses the presence of a cartridge 122 in the weapon barrel 111. When a cartridge 122 abuts the first arm 142, see FIG. 22, the first sensing or blocking lever 140 is pivoted about its axis 141 to such an extent that a second arm 143 of the first sensing lever 140 is disengaged from the deflector 127 which thereby is released for pivoting movement.

A second sensing lever 144 serves to monitor cartridges which remain stuck. This second sensing lever 144 is pivotably mounted at one end of a rod 145. At the other end of the rod 145, which is mounted in the weapon housing 113, there is mounted a retain latch or pawl 146. In the position as shown on the left in the lower portion of FIG. 22 and in FIG. 26, this retaining latch or pawl 146 prevents pivoting of the deflector 128. When a cartridge 122 remains stuck in the weapon barrel 111, the second sensing lever 144 is pivoted during rotation of the rotor 110, and thus, the retaining latch 146 is also pivoted via the rod 145 in order to release the deflector or switching element 128.

An operating lever 147 is mounted at an ignition or firing pin 121 which cooperates with a suitable control cam which is not particularly shown in the drawings. This control cam appropriately releases the ignition or firing pin 121 at the right instant for penetrating the cartridge 122.

Figure 23:
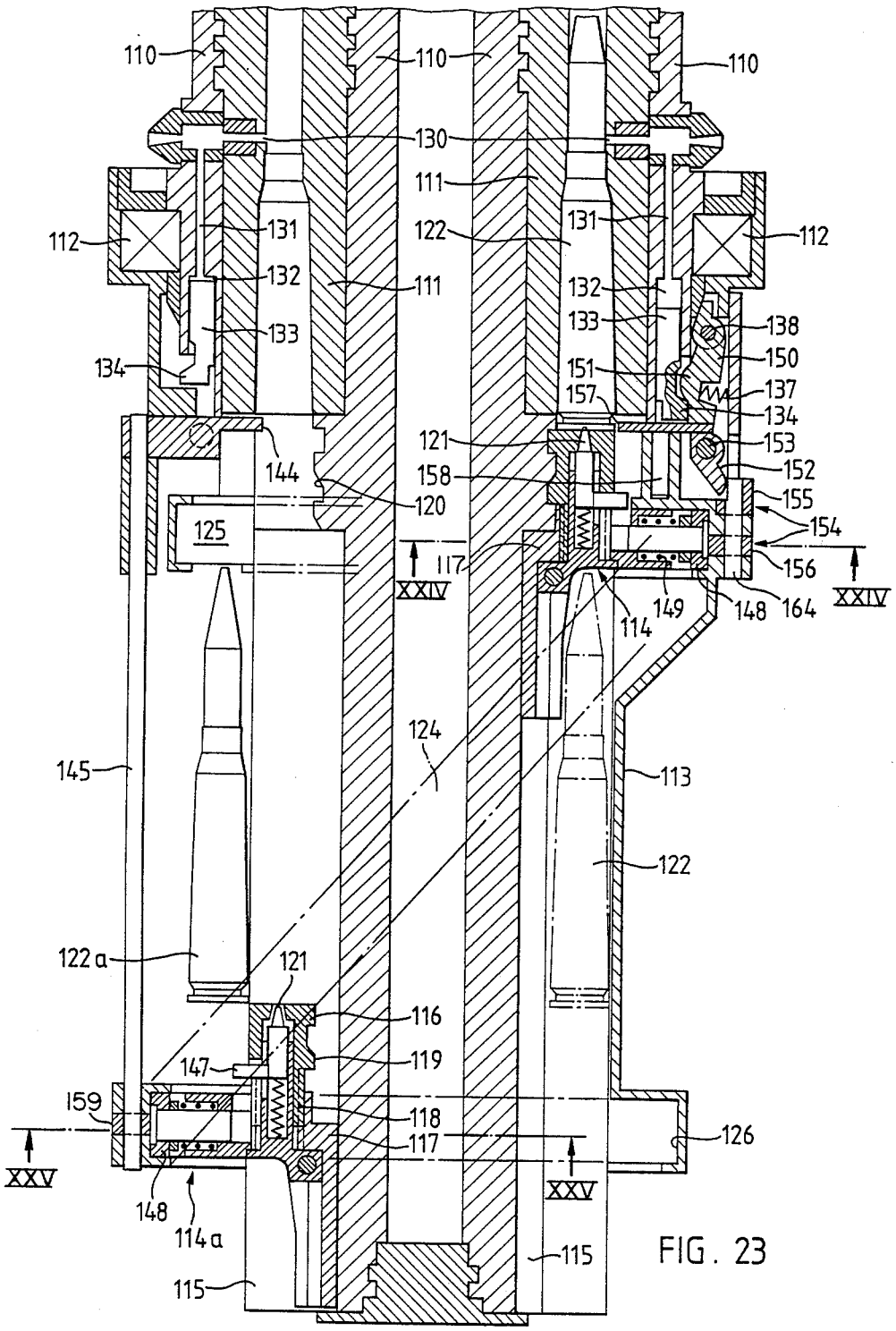
FIG. 23 is a longitudinal section similar to that of FIG. 16 through a firing weapon incorporating a sixth embodiment of the safety apparatus or equipment according to the invention.
Figure 24:
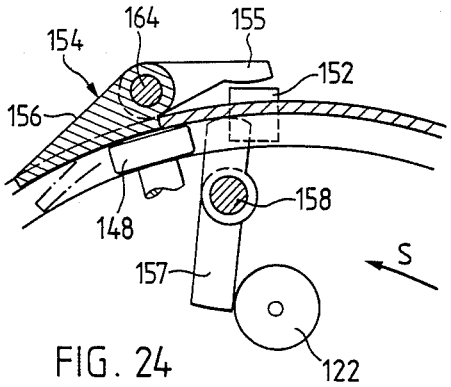
FIG. 24 is a cross-section through details of the firing weapon as illustrated in FIG. 23.
Figure 25:
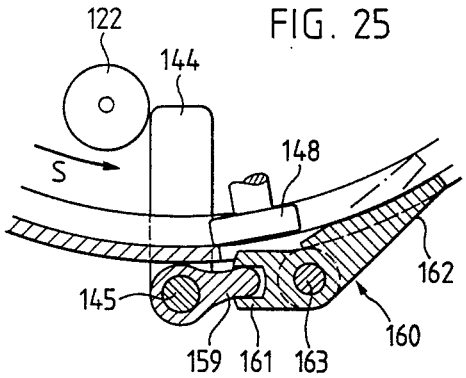
FIG. 25 is a cross-section through details of the firing weapon as illustrated in FIG. 23.

As to the sixth embodiment of the inventive safety or anti-hangfire apparatus such is shown in FIGS. 23, 24 and 25 in conjunction with a weapon into which such safety or anti-hangfire apparatus is incorporated. This sixth embodiment differs from the fifth embodiment as described hereinbefore with reference to FIG. 22 essentially by the hereinafter to be described features, wherein members or parts already described with reference to FIGS. 22 and 26 will not be further described herein. As shown in FIG. 23, a cam follower roll 148 is axially displaceably arranged at the breechblock 114. A spring 149 tends to radially outwardly displace this cam follower roll 148. The first substantially elliptical control cam 124 has a greater depth than the second and third substantially circular-shaped control cams 125 and 126. As long as the cam follower roll 148 is pressed against the base of the deeper or greater depth first control cam 124 by means of the spring 149, thus the cam follower roll 148 will remain engaged with the first elliptical control cam 124. The cam follower roll 148 must be radially inwardly displaced against the force of the spring 149 in order to pass into either one of the two circular-shaped second and third control cams 125 or 126. A deflector or switching element for deflecting the cam follower roll 148 from the first control cam 124 into either the second or the third control cam 125 or 126 is here no longer required. The arrangement for radially displacing the cam follower roll 148 as mentioned hereinbefore is structured in a manner as described hereinafter:

A gas pressure operable piston 133 is present in this sixth embodiment just as in the fifth embodiment described hereinbefore with reference to FIGS. 22 and 26 of the drawings. An actuating mechanism or actuating lever 150 possessing a cam 151 cooperates with the gas pressure operable piston 133 as will be seen in FIG. 23. This cam 151 abuts against the cam 134 of the gas pressure operable piston 133 as mentioned hereinbefore when the gas pressure operable piston 133 has not been displaced under the action of gas pressure into the position as shown in the upper portion of FIG. 23. A latch or pawl 152 is linked for pivoting about an axis or pivot shaft 153 at the actuator lever 150. A first idle latch or pawl 154 comprises a first arm 155 which, as shown in FIG. 24, engages with the already mentioned latch or pawl 152 and a second arm 156 cooperating with the cam follower roll 148. The first idle latch or pawl 154 is mounted for pivoting about an axis or pivot shaft 164 in the weapon housing 133. The latch or pawl 152 which is linked to the actuating lever 150 can operate on the first idle latch or pawl 154 only when a first sensing or blocking lever 157 is placed thereunder. The first sensing lever 157 is mounted for pivotal movement about an axis or pivot shaft 158 in the weapon housing 113 and senses the presence of a cartridge 122 in the barrel 111 as illustrated in FIG. 24. In the presence of a cartridge 122 the first sensing lever 157 assumes the position as shown, whereby such first sensing lever 157 is placed under or engages with the latch or pawl 152 as shown in FIGS. 23 and 24.

The second sensing lever 144 which, as mentioned hereinbefore, serves to monitor cartridges which have remained stuck, is secured to the rod 145 which is mounted in the weapon housing 113. Furthermore, and as shown in FIG. 25, a cam 159 is mounted at the rod 145 and engages a fork or bifurcated member 161 of a second idle latch or pawl 160. This second idle latch 160 is mounted for pivoting about an axis or pivot shaft 163 in the weapon housing 113 and comprises, in addition to the aforementioned fork member 161, an arm 162. This arm or arm member 162 cooperates with the cam follower roll 148 of the breechblock 114 as shown in FIGS. 23 and 25. As will be evident from FIG. 25, a cartridge 122 which has remained stuck will pivot in clockwise direction the second sensing lever 144, whereby also the cam 159 will be pivoted in the same direction. The second idle latch or pawl 160, then, is pivoted in counterclockwise direction. The cam follower roll 148 is displaced against the force of the spring 149 (see FIG. 23) by such pivoting of the second idle latch 160.

The mode of operation of the fifth and sixth embodiments of the safety or anti-hangfire apparatus according to the invention as described hereinbefore with reference to FIGS. 22 to 26 of the drawings will now be described.

Upon counterclockwise rotation of the rotor 110 as indicated by the arrow S in FIGS. 24 to 26, the breechblocks 114 are continuously reciprocated or moved back-and-forth since the cam follower roll 123 or 148, respectively, is guided in the related first elliptical control cam 124. During forward displacement of the breechblock 114 the cartridge 122, which is indicated by dash-dotted phantom lines, is rammed into the related weapon barrel 111 and the breechblock head 116 is locked in the rotor 110. At the same time a further cartridge 122*a* is supplied by means of a conventional ammunition conveyor which is not here shown, to the breechblock 114*a* which is in its rearmost or rear position. The cartridge 122 inserted into the weapon barrel 111 is ignited by the ignition or firing pin 121 after the breechblock head 116 has been locked. As a consequence of such ignition, propellant charge gases enter the gas chamber or compartment 132 through the gas intake orifice 130 and the gas intake passage or channel 131, whereby the gas pressure operable piston 133 is entirely rearwardly displaced, i.e. to the bottom as viewed in FIG. 22. During rotation of the rotor 110 the gas pressure operable piston 133 is entrained during such rotary movement and thus the cam 134 thereof cannot abut against the cam 135 of the blocking lever 136 which thus is not actuated.

In the event that the cartridge 122 ignites only with a certain time-delay or not at all, then no propellant charge gas will enter the gas chamber 132 and the gas pressure operable piston 133 is accordingly not displaced. During rotation of the rotor 110 the gas pressure operable piston 133 is entrained during the rotary movement and now, however, the cam 134 thereof abuts the cam 135 of the blocking lever 136 which is mounted in the weapon housing 113. This blocking lever 136 is thus pivoted against the force of the spring 137. The blocking lever 136 thus is disengaged from the recess 139 in the deflector 127, whereby such deflector 127 is no longer retained. The cam follower roll 123 which moves in the direction of the arrow S, see FIG. 26, now abuts against the thus released deflector 127. Due to this abutment action by the cam follower roll 123 such deflector or switching element 127 is completely pivoted and the cam follower roll 123 now passes from the first elliptical control cam 124 into the second circular-shaped control cam 125. The breechblock 114 thus is no longer rearwardly displaced and remains locked in its forwardmost position. Since the deflector 127 has been unlocked or released, i.e. is no longer retained by the blocking lever 136, the breechblocks 114 of the remaining five weapon barrels 111 also will remain in their forwardmost and locked position during further rotation and the weapon is disabled from firing.

The mode of operation of the sixth embodiment of the safety or anti-hangfire apparatus as shown in FIG. 23 operates somewhat differently. In the event that in this embodiment the cartridge is ignited only with some time-delay or not at all, then no propellant charge gas will enter the gas chamber 132 and the gas pressure operable piston 133 is not displaced. During rotation of the rotor 110 the gas pressure operable piston 133 is entrained with the rotary movement. The cam 134 of the gas pressure operable piston 133 then abuts against the cam 151 of the actuating lever 150 which is mounted in the weapon housing 113. The actuating lever 150 is thus pivoted about the axis or pivot shaft 138. The first idle latch or pawl 154 is thus pivoted in counterclockwise direction as shown in FIG. 24 via the latch 152 under which the first sensing lever 157 is placed. Due to such movement the second arm 156 of the first idle latch 154 is pressed towards the center of the rotor 110. The associated breechblock 114 which is guided at the rotor 110 abuts against the second arm 156 of the first idle latch 154 by means of the cam follower roll 148 thereof and the latter is radially inwardly displaced against the force of the spring 149. This cam follower roll 148 thus passes from the first elliptical control cam 124 into the circular-shaped and less deep or shallower second control cam 125. As a consequence the breechblock 114 remains in its forwardmost and locked position. As soon as the rotor 110 further rotates, however, the actuating lever 150 mounted in the weapon housing 113 is no longer supported at the cam 134 of the gas pressure operable piston 133 which is mounted in the rotor 110, and thus, is pivoted back again into its initial position by the action of the spring 137. The first idle latch 154 thus also is moved back into its initial position and the breechblocks 114 of the remaining weapon barrels 111 may be further reciprocated. Therefore, the weapon would further fire with only five of its six weapon barrels 111, but however, this is prevented by automatically stopping the weapon in the case of an ignition delay or hangfire condition.

While there are shown and described present preferred embodiments of the invention, it is to be distinctly understood that the invention is not limited thereto, but may be otherwise variously embodied and practiced within the scope of the following claims.

Accordingly, we claim:

1. A safety apparatus for an externally powered weapon including a weapon barrel and into which cartridges are insertable which may be subject to ignition delay, said safety apparatus comprising:

a breechblock positively reciprocating between a forwardmost position and a rearmost position;

means for locking said breechblock to said weapon barrel in said forwardmost position;

said breechblock comprising a breechblock head and a breechblock carrier which are operatively coupled to each other; and decoupling means for decoupling said breechblock head from said breechblock carrier in said forwardmost position in which said breechblock head is locked to said weapon barrel in response to said ignition delay condition.

2. A safety apparatus for a multi-barrel weapon including a weapon housing, a rotor rotatable in said weapon housing, and a predetermined number of weapon barrels arranged at said rotor and feedable with cartridges which generate gas pressure in said weapon barrel upon ignition thereof and which may be subject to ignition delay, said safety apparatus comprising:

a number of breechblocks each operatively associated with one of said weapon barrels;

reciprocating means drivingly interconnecting said rotor and said breechblocks and reciprocating each one of said breechblocks between a forwardmost position and a rearmost position during said rotation of said rotor in said weapon housing;

each breechblock comprising a breechblock head and a breechblock carrier;

coupling means releasably coupling said breechblock head and said breechblock carrier;

each breechblock being locked in its forwardmost position to the operatively associated one of said weapon barrels;

a gas intake passage provided for each said weapon barrel;

a gas pressure operable piston cooperating with said gas intake passage;

said gas pressure operable piston being displaceable from an operative position to an inoperative position under the action of gas pressure generated in said weapon barrel;

an actuator mechanism at least containing a first coupling member and a second coupling member; and in the event of said ignition delay condition and with said breechlock in its forwardmost position and said gas pressure operable piston in its operative position, said first coupling member of said actuator mechanism being coupled to said gas pressure operable piston and said second coupling member of said actuator mechanism acting upon said coupling means releasably coupling said breechblock head and said breechblock carrier such that said breechblock carrier is decoupled and released from said breechblock head under the action of said reciprocating means and said breechblock head remains locked in its forwardmost position.

3. The safety apparatus as defined in claim 2, wherein:

each said breechblock further comprises a breechblock head support;

said breechblock head being displaceably arranged at said breechlock head support; and said coupling means releasably coupling said breechblock head support with said breechblock carrier.

4. The safety apparatus as defined in claim 2, further including:

guide rails provided at said rotor;

said reciprocating means comprising:

a control cam provided at said weapon housing;

a cam follower roll mounted at each one of said breechblock carriers;

each said cam follower roll engaging said control cam, so that each said breechblock is reciprocatingly displaced along said guide rails during rotation of said rotor; and a related one of said breechblock carriers being rearwardly displaced along said guide rails while the associated breechblock head is held by said second coupling member of said actuator mechanism in said forwardmost locked position to said weapon barrel during said ignition delay condition.

5. The safety apparatus as defined in claim 4, further including:

a weapon housing;

ammunition feed housing means;

a deflector pivotably mounted between first and second pivot positions at said ammunition feed housing means;

a cartridge ejection channel provided for said ammunition feed housing means;

said deflector, in its first pivot position, guiding cartridges supplied from said ammunition feed housing means to said weapon housing; and pivoting means pivoting said deflector into its second pivot position in the event of said ignition delay condition; and said deflector, in its second pivot position, deflecting cartridges supplied from said ammunition feed housing means to said cartridge ejection channel.

6. The safety apparatus as defined in claim 5, wherein:

said pivoting means contain a contact bolt which contacts a cartridge which has remained stuck in the weapon barrel during said ignition delay condition.

7. A safety apparatus for a multi-barrel weapon including a weapon housing, a rotor rotatable in said weapon housing, and a predetermined number of weapon barrels arranged at said rotor and feedable with cartridges which generate gas pressure in said weapon barrel upon ignition thereof and which may be subject to ignition delay, said safety apparatus comprising:

a number of breechblocks each operatively associated with one of said weapon barrels;

reciprocating means drivingly interconnecting said rotor and said breechblocks and reciprocating each one of said breechblocks between a forwardmost position and a rearmost position during said rotation of said rotor in said weapon housing;

each breechblock comprising a breechblock head and a breechblock carrier;

coupling means releasably coupling said breechblock head and said breechblock carrier;

each breechblock being locked in its forwardmost position to the operatively associated one of said weapon barrels;

a gas intake passage provided for each said weapon barrel;

a gas pressure operable piston cooperating with said gas intake passage;

said gas pressure operable piston being displaceable from an operative position to an inoperative position under the action of gas pressure generated in said weapon barrel;

an actuator mechanism at least containing a first coupling member and a second coupling member;

in the event of said ignition delay condition and with said breechblock in its forwardmost position and said gas pressure operable piston in its operative position, said first coupling member of said actuator mechanism being coupled to said gas pressure operable piston and said second coupling member of said actuator mechanism acting upon said coupling means releasably coupling said breechblock head and said breechblock carrier such that said breechblock carrier is decoupled and released from said breechblock head under the action of said reciprocating means and said breechblock head remains locked in its forwardmost position;

coupling means for coupling said breechblock head to said breechblock carrier;

said actuator mechanism being mounted at said weapon housing; and said coupling means comprising:

a retaining bracket;

two latches retainable by said retaining bracket; and a two-armed actuating lever in engagement with said actuator mechanism mounted at said weapon housing.

8. The safety apparatus as defined in claim 7, further including:

a displaceable slide means at which said two-armed actuating lever is pivotably mounted;

a spring acting on said slide means in order to displace the same into an inoperative position;

a contact bolt carried by said slide means;

said contact bolt responding to the presence of a cartridge case of the cartridge in said weapon barrel; and said slide means including said contact bolt and said actuating lever being displaceable into said inoperative position of said slide means under the action of said spring in the absence of said cartridge.

9. The safety apparatus as defined in claim 7, wherein:

said guide rails are provided with recesses;

two pivotable two-armed levers for retaining said breechblock head in said forwardmost locked position;

each of said two-armed levers having one arm engageable with a respective one of said recesses of said guide rails with which said breechblock is operatively associated;

said retaining bracket being provided with grooves;

each of said two-armed levers having another arm thereof engageable with a respective one of said grooves of said retaining bracket; and spring means for urging said two-armed levers to engage said recesses formed in said guide rails and said grooves formed at said retaining bracket.

10. A safety apparatus for an externally powered weapon including a weapon barrel and into which cartridges are insertable which may be subject to an ignition delay condition, said safety apparatus comprising:

a breechblock;

drive means positively reciprocating said breechblock between a forwardmost position and a rearmost position;

first coupling means locking said breechblock in its forwardmost position to said weapon barrel;

said breechblock comprising a breechblock head and a breechblock carrier;

second coupling means releasably coupling said breechblock head and said breechblock carrier;

said drive means being drivingly connected to said breechblock carrier;

an actuator mechanism;

said actuator mechanism containing a response member responding to said ignition delay condition and a release member acting, in the event of said ignition delay condition, upon said second coupling means in order to release said second coupling means and decouple said breechblock head and said breechblock carrier under the action of said drive means such that said breechblock head remains in said forwardmost position and locked to said weapon barrel under the action of said first coupling means.

* * * * *

UNITED STATES PATENT AND TRADEMARK OFFICE

CERTIFICATE OF CORRECTION

PATENT NO. : 4,550,641

DATED : November 5, 1985

INVENTOR(S) : WERNER BRUDERER et al

It is certified that error appears in the above—identified patent and that said Letters Patent is hereby corrected as shown below:

Column 4, line 10, please delete "inan" and insert --in an--

Column 5, line 8, please delete "Tne" and insert --The--

Column 5, line 61, please delete "rrom" and insert --from--

Column 6, line 9, please delete "ro" and insert --to--

Column 6, line 14, please delete "tne" and insert --the--

Column 6, line 34, please delete "tne" and insert --the--

Column 7, line 29, please delete "rhe" and insert --the--

Column 7, line 52, please delete "descr bed"and insert --described--

Column 7, line 64, please delete "rhe" and insert --the--

Column 9, line 61, please delete "counrerclockwise" and insert --counterclockwise--

Column 10, line 34, please delete "nas" and insert --has--

Column 10, line 46, after "FIG." please delete "1" and insert --15--

Column 12, line 13, after "bottom" please insert --as--

Column 12, line 31, please delete "tne" and insert --the--

UNITED STATES PATENT AND TRADEMARK OFFICE

CERTIFICATE OF CORRECTION

PATENT NO. : 4,550,641

DATED : November 5, 1985

INVENTOR(S) : Werner Bruderer et al

It is certified that error appears in the above-identified patent and that said Letters Patent is hereby corrected as shown below:

Column 13, line 1, after "first" please insert --cam--

Column 21, line 61, please delete "and".

Signed and Sealed this

*Twenty-fifth* Day of *March 1986*

[SEAL]

*Attest:*

DONALD J. QUIGG

*Attesting Officer* *Commissioner of Patents and Trademarks*